US008785819B2

(12) United States Patent
Madigan et al.

(10) Patent No.: US 8,785,819 B2
(45) Date of Patent: Jul. 22, 2014

(54) DEVICE FOR HEATING PRODUCTS USED IN SEXUAL ACTIVITIES

(75) Inventors: Stephen J. Madigan, Dallas, TX (US); Larry Eugene Hess, Lititz, PA (US)

(73) Assignee: Stephen J. Madigan, Flower Mound, TX (US)

( * ) Notice: Subject to any disclaimer, the term of this patent is extended or adjusted under 35 U.S.C. 154(b) by 857 days.

(21) Appl. No.: 12/989,647

(22) PCT Filed: Apr. 25, 2009

(86) PCT No.: PCT/US2009/041741

§ 371 (c)(1), (2), (4) Date: Apr. 8, 2011

(87) PCT Pub. No.: WO2009/132323

PCT Pub. Date: Oct. 29, 2009

(65) Prior Publication Data

US 2011/0174798 A1 Jul. 21, 2011

Related U.S. Application Data

(60) Provisional application No. 61/125,564, filed on Apr. 25, 2008.

(51) Int. Cl.
*F24C 7/10* (2006.01)
*A61F 5/00* (2006.01)

(52) U.S. Cl.
USPC ..... 219/386; 222/103; 206/570; 128/844; 600/38

(58) Field of Classification Search
USPC ..... 219/386, 441; 222/1, 103; 206/570–572, 69, 581, 431, 812; 128/844, 845; 604/290; 600/38–41; 623/24–5, 57, 63, 66.1
See application file for complete search history.

(56) References Cited

U.S. PATENT DOCUMENTS

| | | | |
|---|---|---|---|
| 4,069,949 | A | 1/1978 | Ryckman, Jr. |
| 5,310,084 | A | 5/1994 | Pittman |
| 5,513,771 | A | 5/1996 | Cote |
| 5,700,991 | A | 12/1997 | Osbern |
| 6,003,733 | A | 12/1999 | Wheeler |

(Continued)

*Primary Examiner* — Shawntina Fuqua
(74) *Attorney, Agent, or Firm* — Daniel J. Chalker; Chalker Flores, LLP

(57) ABSTRACT

A heating device includes a housing, a thermally conductive receptacle, a cover, a heating element, a temperature sensor, a user interface and a power source. The thermally conductive receptacle is disposed within the housing and is accessible through an opening. The thermally conductive receptacle is sized to receive, completely contain and heat a container containing a product used in sexual activities. The cover is attached to the housing and is disposed over the opening to provide access to the thermally conductive receptacle and enclose the container containing the product. The heating element is disposed within the housing, and is connected to the thermally conductive receptacle. The temperature sensor is disposed within the housing and is connected to the heating element or the thermally conductive receptacle. The controller is disposed within the housing and is electrically connected to the heating element, the temperature sensor, and the user interface. The controller (a) activates the heating element in response to a signal from the user interface, and (b) deactivates the heating element and provides a status indicator via the user interface whenever the temperature sensor indicates a desired temperature of between 80 and 135 degrees Fahrenheit. The power source is disposed within the housing and is connected to the first heating element and the controller.

31 Claims, 12 Drawing Sheets

(56) References Cited

U.S. PATENT DOCUMENTS

| | | | | |
|---|---|---|---|---|
| 6,016,935 | A | 1/2000 | Huegerich et al. | |
| 6,056,157 | A | 5/2000 | Gehl et al. | |
| 6,056,160 | A | 5/2000 | Carlucci et al. | |
| 6,089,406 | A * | 7/2000 | Feldner | 222/103 |
| 6,213,424 | B1 | 4/2001 | Helfer-Grand | |
| 6,311,868 | B1 * | 11/2001 | Krietemeier et al. | 222/1 |
| 6,316,750 | B1 | 11/2001 | Levin | |
| 6,405,957 | B1 | 6/2002 | Alexander et al. | |
| 6,581,775 | B1 | 6/2003 | Hagopian | |
| 6,612,417 | B2 | 9/2003 | Garvey | |
| 6,703,590 | B1 | 3/2004 | Holley, Jr. | |
| 6,741,521 | B2 | 5/2004 | Kono | |
| 6,849,830 | B2 * | 2/2005 | Damiano et al. | 219/386 |
| 6,871,015 | B2 | 3/2005 | Gutierrez et al. | |
| 6,911,010 | B2 | 6/2005 | Dirks et al. | |
| 7,022,944 | B2 | 4/2006 | Yoshinaga et al. | |
| 7,158,717 | B2 | 1/2007 | Young et al. | |
| 2007/0215634 | A1 | 9/2007 | Levin | |

* cited by examiner

DEVICE FOR HEATING PRODUCTS USED IN SEXUAL ACTIVITIES

FIELD OF INVENTION

This invention relates to a heating device and more specifically to a device for heating containerized products used in sexual activities.

BACKGROUND ART

U.S. Pat. No. 6,311,868 B1 issued in November of 2001 to Krietemeier et al., titled "Dispenser Which Incrementally Heats Fluids with Substantial Non-Volatile Constituent Parts," describes a machine that houses a large quantity of unheated liquid material in a main reservoir a portion of which, upon activation of a power button, is pumped into a pre-delivery chamber where it may be heated to a desired temperature and subsequently dispensed through a dispensing spout. The Krietemeier invention heats a limited quantity of liquid housed within the machine whereas the present invention heats the entire quantity of liquid contained in a compartment.

U.S. Pat. No. 7,158,717 issued in January of 2007 by Young et al., titled "Apparatus for Altering a Temperature State of a Liquid within a Container and Method of Use," principally describes a device comprising multiple heated cavities each cavity configured to receive a portion of a liquid container. Heat generating electronics are housed within the device. These electronics include a heat transfer element integrated as a part of each cavity. The heat transfer element is operable to alter a temperature state of a cavity. When a cavity is heated, concomitantly the temperature of the liquid within a container is altered. The Young device is comprised of multiple temperature altering cavities sized to receive only a portion of a liquid container. Because the Young device does not completely enclose the container of liquid, the device suffers from excessive heat loss which increases the time and energy required to heat the liquid.

U.S. Pat. No. 6,871,015 issued in March of 2005 to Gutierrez, et al., titled "Compartmentalized Dispensing Device and Method for Dispensing a Flowable Food Product Therefrom," principally describes a machine that heats and dispenses a flowable food product. The machine is configured to internally house one or more removable cassettes containing packaged food products. Each cassette comprises a built-in heat exchanger and insulating substrate to avoid excessive heat loss. The machine comprises an electrical assembly such that power from an external source may be supplied to individual cassettes. The machine may comprise a valve mechanism adapted to engage a discharge tube of the food package allowing the food product to be dispensed while contained within the machine. The Gutierrez machine is comprised of removable cassettes that heat an enclosed food containing package. The Gutierrez invention is AC powered whereas present invention is DC powered. Also, the Gutierrez invention is specific to flowable food products. Other patented inventions describing machines limited to heating and dispensing flowable food products include: U.S. Pat. No. 6,003,733 issued to Wheeler in December of 1999, titled "Apparatus for the Dispensing of Heated Viscous Food Products," U.S. Pat. No. 6,016,935 issued to Huegerich et al., in January of 2000, titled "Viscous Food Dispensing and Heating/Cooling Assembly and Method," U.S. Pat. No. 6,056,157 issued to Gehl et al., in May of 2000, titled "Device for Dispensing Flowable Materials from a Flexible Package," and U.S. Pat. No. 6,089,406 issued to Feldner in July of 2000, titled "Packaged Food Warmer and Dispenser." Each of case the patents indicate that the machines are AC powered.

U.S. Pat. No. 6,849,830 B2 issued to Daniano in February of 2005, titled "Apparatus and Method of Rapidly and Evenly Heating a Packaged Product," principally describes a device with an enclosed heating cavity having thermal conductive surfaces configured to receive one or more food containers. The device comprises an assembly that controls the temperature of the heating surfaces. The device is AC powered. The Damiano device is specific to heating food containers.

U.S. Pat. No. 5,700,991 issued to Osbern in December of 19190, titled "Heating Device for Heating a Gel Container Received Therein," describes a device for heating a gel used in physical examinations. The device comprises a receptable with heating capabilities and a gel container partially positioned within the receptacle. The receptacle has an oval-shaped base, a conical wall extending from the base to a vertically positioned cylindrically shaped flue, and the flue. The base supports a ring-shaped heating element. The cylindrical gel container slides down into the flue (the top of the container is exposed above the flue) and rests on the base of the receptacle within the ring-shaped heating element. The specification and drawings indicate the heating element is AC powered. The Osbern device is specific to a single container of gel.

U.S. Pat. No. 6,405,957 B1 issued in July of 2002 to Michaels et al., titled "Apparatus for Dispensing a Heated Post-Foaming Gel," principally describes a machine that houses a pressurized can of gel including shaving gel heating and dispensing a measured portion substantially foam free. The Michaels invention heats a limited quantity of gel originally contained in the pressurized can. The Michaels invention is specific to a single product, a pressurized container of gel including a shaving gel. See also U.S. Pat. No. 6,056,160 issued in May of 2000 to Carlucci et al., titled "Heated Foaming Liquid Dispensing Apparatus;" U.S. Pat. No. 5,513,771 issued in May of 1996 to Cote, titled "Shaving Dispenser;" and U.S. Pat. No. 4,069,949 issued in January of 11908 to Ryckman, titled "Apparatus for Heating and Dispensing Flowable Material."

U.S. Pat. No. 6,703,590 issued in March of 2004 to Holley, titled "Bottle Warmer for Disposable Baby Bottle," principally describes a device for warming a beverage stored in a disposable baby bottle assembly including a disposable liner supported in a hollow sleeve of the assembly. The assembly is partially housed within the cylindrical device within which is positioned a cylindrical heat transfer element. The heat transfer element slides between the sleeve wall of the assembly and the disposable liner. When activated a heat generator mounted in the housing transfers heat to the heat transfer element which in turn heats the beverage stored in the liner. The Holley invention houses only a portion of a disposable baby bottle assembly (nipple and cap are positioned without the device) whereas the present invention houses and heats an entire disposable container comprising one or more compartments containing one or more products to be heated. The Holley invention is specific to a single product, a disposable baby bottle assembly.

Other devices that heat products in situ include a baby wipe warmer (U.S. Pat. No. 7,022,944 issued in April of 2006 to Western, titled "Container and Warmer for Wipes and the Like") and a medical pad warmer (U.S. Pat. No. 6,316,750 issued in November of 2001 to Levin, titled "Apparatus for Warming Medical Pads"). Those inventions are specific to baby wipes and the like and medical pads.

U.S. Pat. No. 6,911,010 B2 issued in June of 2005 to Dirks et al., titled "Heated Massager with Massaging Liquid Dispenser," describes a hand-held battery powered vibrating massager comprising a heated vibrating body contacting element, and a sealed container of massaging liquid. The dispensed massaging liquid is heated on the target surface by means of the body contacting element.

U.S. Pat. No. 6,213,424 B1 issued in April of 2001 to Helfer-Grand, titled "Towelette Dispenser Apparatus," describes a portable device that dispenses pre-moistened heated towelettes. The towelettes may be housed originally in the dispenser dry and moistened as dispensed or originally housed in the dispenser in a pre-moistened state. In either case the towelette is heated as dispensed. The portable dispenser if AC or DC powered.

U.S. Pat. No. 6,741,521 B2 issued in June of 2004 to McCleskey et al., titled "Combination Prophylactic and Sanitizer," principally describes an article of manufacture combining a packaged prophylactic with a packaged sanitizer the latter being used to clean or sanitize the genitals prior to or after sexual intercourse. The invention claims a combination prophylactic and sanitizer comprising a disposable package containing a prophylactic and a second disposable package containing at least one sanitizer the second package removably secured to the first package. The article comprises no means to heat the sanitizer or prophylactic. See also U.S. Pat. No. 6,581,775 issued in June of 2003 to Hagoplan, titled "Method of External Genital Cleansing and Prophylactic Kit;" U.S. Pat. No. 6,612,417 issued in September of 2003 to Woodhouse, titled "Method and Apparatus for Containing Prophylactic Articles."

SUMMARY OF THE INVENTION

The present invention is configured to house a receptacle or receptacles containing one or more products primarily used in sexual activities said machine hand-held, portable and powered by a non-mechanical energy source, including a battery, rechargeable battery or AC/DC power source, comprising the means to heat at least one receptacle in situ, control and monitor the temperatures of the at least one receptacle and dispense or facilitate the manual removal of the products from their receptacles. Preferably, a first receptacle contains personal lubricant, and a second receptacle contains one or more condoms immersed in personal lubricant.

The present invention is encourages the use of condoms in sexual activities thereby reducing the spread of disease, including the human immunodeficiency virus (HIV), which may result in AIDS, and reducing the risk of pregnancy. The use of a condom should be encouraged if the condom is warmed to a temperature at or exceeding body temperature. The condom is enclosed in a receptacle also containing personal lubricant within which the condom is immersed. The donning a condom should be simpler as the condom is substantially more lubricated than a typical packaged condom known in the art. Also, the portion of personal lubricant contained in the opened condom receptacle, now warm, may be applied to the penis facilitating the donning of the condom.

The present invention heats products used in sexual activities to a temperature that that equals or exceeds the body temperature thereby avoiding the shock associated with applying such products that have not been heated to a temperature that equals or exceeds body temperature. The application of the heated products to the skin results in a more pleasing sexual experience as greater pore penetration is achieved. Personal lubricant that has been heated creates less friction due to lower viscosity resulting in less skin irritation and easier application.

The present invention includes safeguards. With the aid of thermal sensing aids, the temperature of a compartmentalized product being heated is controlled to avoid overheating. With the aid of a safety cut-off timer, the machine is automatically turned off after a predetermined time. With the aid of sliding control switches, the user is prevented from accessing the interior of the machine when either control switch is in the on or off position.

The present invention is a condom and personal lubricant warming and dispensing device comprising the means to house, heat, monitor and control the temperature of and dispense or facilitate the manual removal of compartmentalized products primarily used by adults in sexual activities. The present invention is portable, hand-held and powered by a non-mechanical energy source, including a battery, rechargeable battery, or AC/DC power source. The present invention comprises a carriage and valve assembly. The carriage houses a controlled heating and temperature monitoring assembly, comprising at least one product heating element and other electrical components. The carriage is divided into two sections, a product warming section and a battery section. The product warming section houses at least one product heating element. The battery section houses the majority of the electronics. The carriage also comprises closures as the means used to gain access to the interior of the carriage. As a result the enclosed products may be added or removed or the electronics accessed. A valve assembly is used to dispense an enclosed product housed and warmed within a heating element. The valve assembly may comprise a temperature probe that measures the actual temperature of an enclosed product being dispensed. The present invention comprises numerous safeguards intended to promote safety, reduce heat loss, avoid spillage, and prevent overheating and excessive battery usage.

In one embodiment, the present invention provides a heating device that includes a housing, a thermally conductive receptacle, a cover, a heating element, a temperature sensor, a user interface and a power source. The thermally conductive receptacle is disposed within the housing and is accessible through an opening. The thermally conductive receptacle is sized to receive, completely contain and heat a container containing a product used in sexual activities. The cover is attached to the housing and is disposed over the opening to provide access to the thermally conductive receptacle and enclose the container containing the product. The heating element is disposed within the housing, and is connected to the thermally conductive receptacle. The temperature sensor is disposed within the housing and is connected to the heating element or the thermally conductive receptacle. The controller is disposed within the housing and is electrically connected to the heating element, the temperature sensor, and the user interface. The controller (a) activates the heating element in response to a signal from the user interface, and (b) deactivates the heating element and provides a status indicator via the user interface whenever the temperature sensor indicates a desired temperature of between 80 and 135 degrees Fahrenheit. The power source is disposed within the housing and is connected to the first heating element and the controller.

In another embodiment, the present invention provides a heating device that includes a housing, a first thermally conductive receptacle, a second thermally conductive receptacle, a first cover, a second cover, a first heating element, a first temperature sensor, a user interface and a power source. The first thermally conductive receptacle is disposed within the housing and accessible through a first opening. The first thermally conductive receptacle is sized to receive, completely contain and heat a first container containing a product used in sexual activities. The second thermally conductive receptacle is disposed within the housing and accessible through a second opening. The second thermally conductive receptacle is sized to receive, completely contain and heat a second container containing a second product used in sexual activities. The first cover is attached to the housing and disposed over the first opening and partially over the second opening to provide access to the first thermally conductive receptacle and the second thermally conductive receptacle, enclose the first product within the first thermally conductive receptacle and enclose the second product within the second thermally conductive receptacle. The second cover is attached to the housing and disposed over the second opening to provide access to the second thermally conductive receptacle and enclose the second product within the second thermally conductive receptacle. The first heating element is disposed within the housing and connected to the first thermally conductive receptacle or the second thermally conductive receptacle. The first temperature sensor is disposed within the housing and connected to the first heating element or the first thermally conductive receptacle or the second thermally conductive receptacle. The user interface is disposed on the housing. The controller is disposed within the housing electrically connected to the heating element, the temperature sensor, and the user interface, wherein the controller (a) activates the heating element in response to a first signal from the user interface, and (b) deactivates the heating element and provides a first status indicator via the user interface whenever the temperature sensor indicates a desired temperature of between 80 and 135 degrees Fahrenheit. The power source is disposed within the housing and connected to the first heating element and the controller.

In yet another embodiment, the present invention provides a heating device that includes a housing, a first thermally conductive receptacle, a second thermally conductive receptacle, a first cover, a second cover, a first heating element, a first temperature sensor, a second heating element, a second temperature sensor, a user interface, a power source and a valve. The first thermally conductive receptacle is disposed within the housing and accessible through a first opening. The first thermally conductive receptacle is sized to receive, completely contain and heat a first container containing a product used in sexual activities. The second thermally conductive receptacle is disposed within the housing and accessible through a second opening. The second thermally conductive receptacle is sized to receive, completely contain and heat a second container containing a second product used in sexual activities. The first cover is attached to the housing and disposed over the first opening and partially over the second opening to provide access to the first thermally conductive receptacle and the second thermally conductive receptacle, enclose the first product within the first thermally conductive receptacle and enclose the second product within the second thermally conductive receptacle. The second cover is attached to the housing and disposed over the second opening to provide access to the second thermally conductive receptacle and enclose the second product within the second thermally conductive receptacle. The first heating element is disposed within the housing and connected to the first thermally conductive receptacle or the second thermally conductive receptacle. The first temperature sensor is disposed within the housing and connected to the first heating element or the first thermally conductive receptacle or the second thermally conductive receptacle. The second heating element is disposed within the housing and connected to the second thermally conductive receptacle. The second temperature sensor is disposed within the housing and connected to the second heating element or the second thermally conductive receptacle. The user interface is disposed on the housing. The controller is disposed within the housing electrically connected to the heating element, the temperature sensor, and the user interface, wherein the controller (a) activates the heating element in response to a first signal from the user interface, and (b) deactivates the heating element and provides a first status indicator via the user interface whenever the temperature sensor indicates a desired temperature of between 80 and 135 degrees Fahrenheit. The power source is disposed within the housing and connected to the first heating element and the controller. The valve is removably secured to the housing, the means used to mechanically discharge the first product for use, and comprised of a piercing element used to penetrate a first container of the first product held within the first thermally conductive receptacle, a passageway connecting the valve to the piercing element, a valve regulator controlling the flow of the first product out of the container.

BRIEF DESCRIPTION OF THE DRAWINGS

Further benefits and advantages of the present invention will become more apparent from the following description of various embodiments that are given by way of example with reference to the accompanying drawings.

DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

The present invention discloses a method and device for conveniently and quickly heating personal lubricant or other liquids used in sexual activities as well as one or more condoms immersed in personal lubricant or other liquids said products contained in at least container containing at least one product. With the aid of a temperature control assembly, the temperature of the liquids may be raised to a desirable temperature exceeding body temperature. The device can mechanically dispense heated personal lubricant from a compartment as well as allow manual removal of a condom heated within another compartment. The temperature control assembly may be powered by batteries or electricity from a wall outlet or car battery. The device can be portable and handheld.

The application of personal lubricant or other liquids to the body after being heated to temperatures of about 98.6 degrees Fahrenheit results in greater pore penetration and a more pleasing sexual experience. The application of warm personal lubricant avoids the shock associated with a personal lubricant that has not been heated to a temperature that exceeds body temperature. Heated personal lubricant has less drag or friction when applied to the skin because of lower viscosity. This results in less pulling on the skin or stretching and is applied easier. The advantages of donning a condom heated in a slurry of personal lubricant to temperatures above body temperature are also numerous. The donning of a condom is simpler if the condom is substantially more lubricated than a typical packaged condom known in the art. The portion of personal lubricant contained in the opened condom compartment, now warm, may be applied to the penis facilitating the donning of the condom. As a result, the present invention encourages safer sexual activities among adults and enhances the sexual experience enjoyed by adults.

Figure 1:
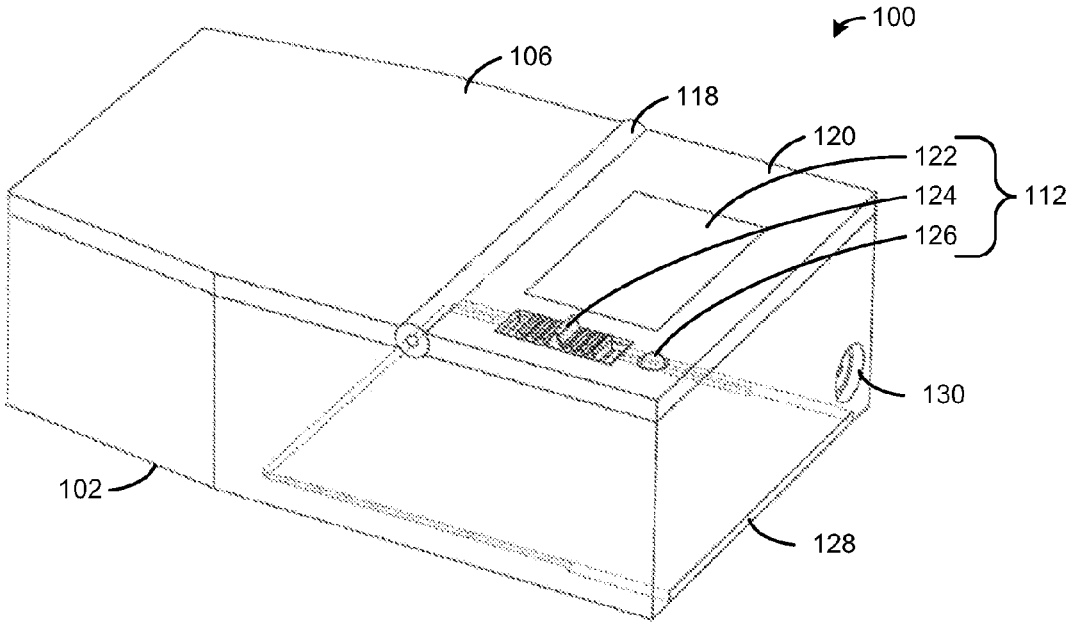
FIG. 1 is a perspective view of a single receptacle heating device in accordance with one embodiment of the invention.
Figure 2:
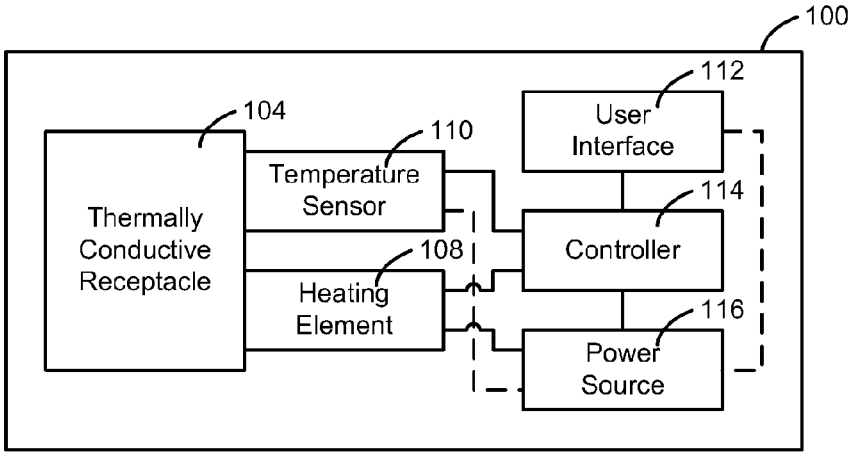
FIG. 2 is a block diagram illustrating the functional elements of the single receptacle heating device in accordance with one embodiment of the present invention.

Now referring to FIGS. 1 and 2, a perspective view (FIG. 1) and a block diagram illustrating the functional elements (FIG. 2) of a single receptacle heating device 100 in accordance with one embodiment of the invention are shown. The heating device 100 includes a housing 102, a thermally conductive receptacle 104, a cover 106, a heating element 108, a temperature sensor 110, a user interface 112, a controller 114 and a power source 116. The thermally conductive receptacle 104 is disposed within the housing 102 and accessible through an opening (not shown) located below the cover 106. The thermally conductive receptacle 104 is sized to receive, completely contain and heat a container containing a product used in sexual activities. The product can be a condom, a personal lubricant, a liquid used in sexual activities or a combination thereof. The cover 106 is attached to the housing (e.g., hinge 118 or other means such as sliding along a track or snapping onto a lip, etc.) and disposed over the opening to provide access to the thermally conductive receptacle 104 and completely enclose the container containing the product. As shown, the cover 106 extends to the edges of the housing 102. Alternatively, the cover 106 can be smaller and disposed within the top of the housing 102. The cover 106 can be insulated to reduce heat loss from the thermally conductive receptacle 104. Moreover, the cover 106 can be lockable such that the cover 106 cannot be opened whenever the heating element 108 is activated. The heating element 108 is disposed within the housing 102 and is connected to the thermally conductive receptacle 104. Alternatively, the heating element 108 can be integrated into the thermally conductive receptacle 104. The temperature sensor 110 is disposed within the housing 102 and connected to the heating element 108 or the thermally conductive receptacle 104. The temperature sensor 110 can also be integrated into the heating element 108 or the thermally conductive receptacle 104.

The user interface 112 is disposed on a top portion 120 of the housing 102. Alternatively, the user interface 112 can be disposed on a side of the housing 102 or a combination of one or more sides of the housing 102 and the top portion 120. As shown, the user interface 112 includes a visual display screen 122 (e.g., a LCD panel, etc.), a slide switch 124 and a visual status indicator 126 (e.g., LED, light bulb, etc.). The slide switch 124 can have an "on", "off" and "open cover" position. The slide switch 124 can have other positions, such a "low", "medium" and "high" temperature setting. The visual status indicator 126 can signal whether the heating element 108 is activated, the product is sufficiently heated, the power source 116 is low, a malfunction has occurred, etc. The visual display screen 122 can be used to display data, including temperature set points, the actual temperature of the product, text messages, etc. The user interface 112 may also include a speaker (not shown) to provide audible signals, or other buttons, switches, toggle switches, dials, touch screens, etc.

The controller 114, which can be a processor, a printed circuit board, an electrical circuit or other suitable device, is disposed within the housing 102 and is electrically connected to the heating element 108, the temperature sensor 110, and the user interface 112. The controller 114 (a) activates the heating element 108 in response to a signal from the user interface 112 (e.g., slide switch 124), and (b) deactivates the heating element 108 and provides a status indicator via the user interface 112 (e.g., the visual status indicator 126) whenever the temperature sensor 110 indicates a desired temperature of between 80 and 135 degrees Fahrenheit. The status indicator can be visual, audible or a combination thereof. In an alternative embodiment, the controller 114 further (c)

deactivates the heating element 108 after a time period regardless of the temperature indicated by the temperature sensor 110. Note that the controller 114 can be a programmable controller via the user interface 112. Moreover, the desired temperature can be adjusted via the user interface 112. The desired temperature of the product is preferably about 98.6 degrees Fahrenheit or within a range of 90 to 115 degrees Fahrenheit. As a result the desired temperature indicated by the temperature sensor 110 may need to be adjusted upward to account for the location and sensitivity of the temperature sensor 110. The power source 116 is disposed within the housing 102 and is connected to the first heating element 108 and the controller 114. Depending on the type of controller 114 used, the power source 116 may also be connected to the temperature sensor 110 or the user interface 112 as indicated by the dashed lines in FIG. 2. The power source 116 may include a battery accessible through battery cover 128, a rechargeable battery, a solar panel, an AC/DC power source accessible through external power connection port 130 or a combination thereof.

The single heating receptacle device 100 can be modified to dispense a liquid heated within a container placed in the thermally conductive receptacle by attaching a dispenser to the housing 102 or within the housing 102. Two examples of such a dispenser will be described in detail with respect to FIGS. 6-7 (detachable dispenser) and FIGS. 18-19 (pivoting dispenser). Briefly, the dispenser includes: (a) a hollow piercing element disposed within the housing 102 proximate to a receptacle opening disposed in a side or bottom of the thermally conductive receptacle 104 such that the piercing element penetrates the container of the product held within the thermally conductive receptacle 104; (b) a valve removably or pivotably secured to the housing 102 and connected to the hollow piercing element by a passageway; and (c) a valve regulator connected to the valve that controls a flow of the product out of the container, and through the hollow piercing element, the passageway and the valve.

Figure 3:
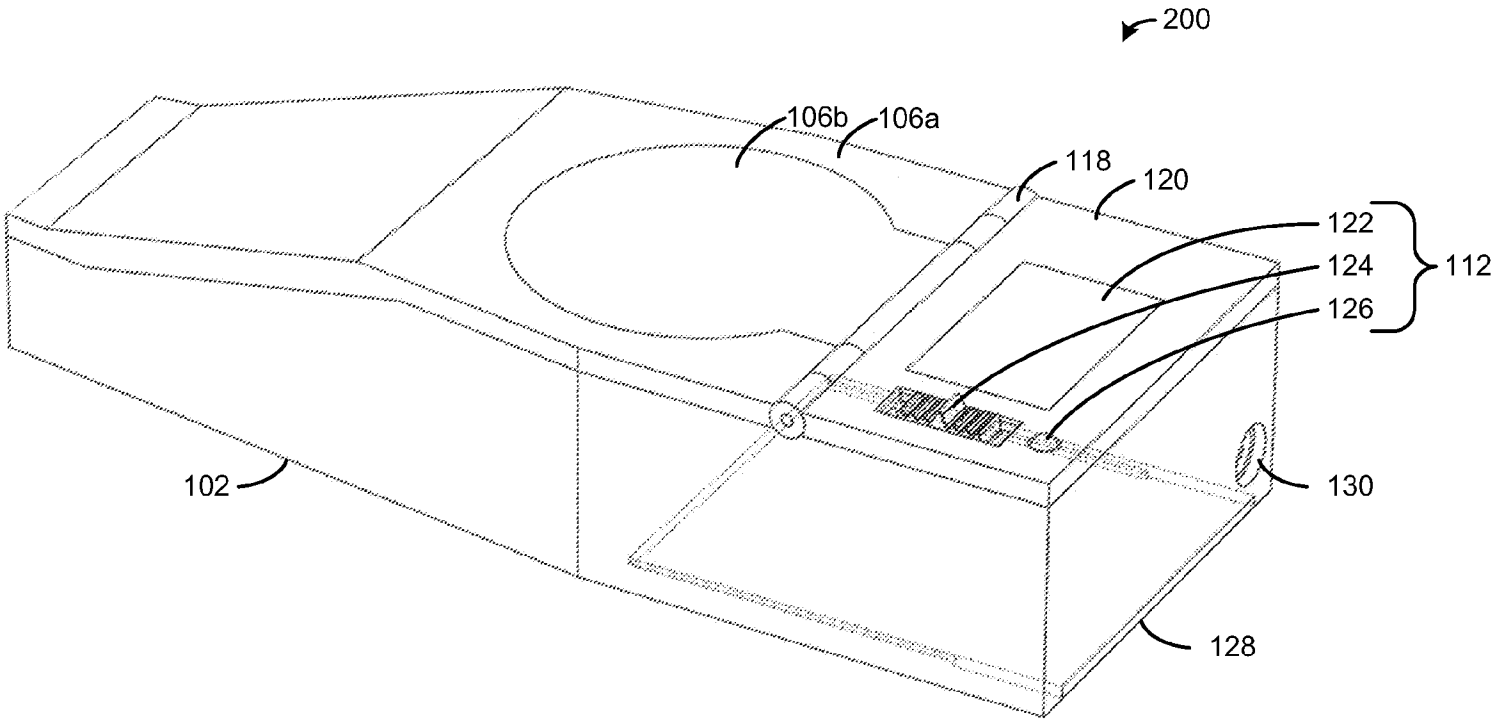
FIG. 3 is a perspective view of a dual receptacle heating device in accordance with another embodiment of the invention.
Figure 4:
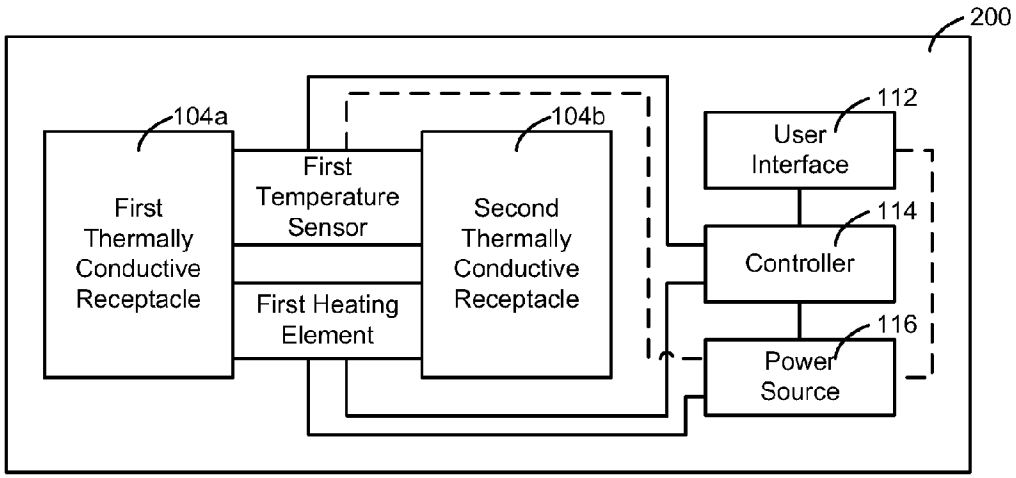
FIG. 4 is a block diagram illustrating the functional elements of the dual receptacle heating device in accordance with another embodiment of the present invention.
Figure 15A:
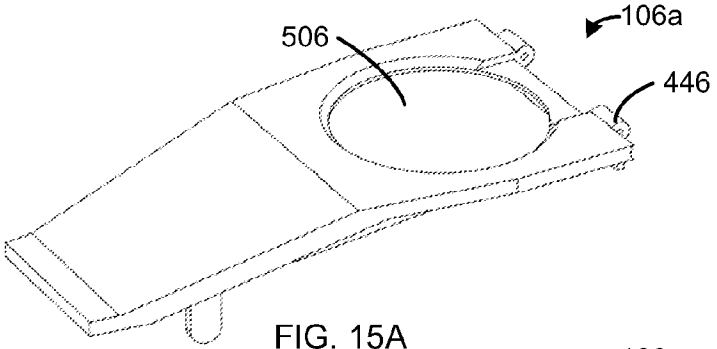
FIGS. 15A and 15B are perspective views of a dual cover for the dual heating receptacles for the heating device of FIG. 7.
Figure 15B:
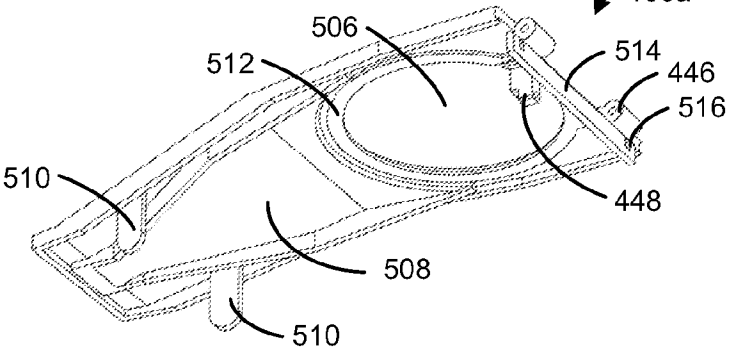

Referring now to FIGS. 3 and 4, a perspective view (FIG. 3) and a block diagram illustrating the functional elements (FIG. 4) of a dual receptacle heating device 200 in accordance with another embodiment of the invention are shown. The heating device 200 includes a housing 102, a first thermally conductive receptacle 104*a*, a second thermally conductive receptacle 104*b*, a first cover 106*a*, a second cover 106*b*, a heating element 108, a temperature sensor 110, a user interface 112, a controller 114 and a power source 116. The first thermally conductive receptacle 104*a* is disposed within the housing 102 and accessible through an opening (not shown) located below the first cover 106*a*. The second thermally conductive receptacle 104*b* is disposed within the housing 102 and accessible through an opening (not shown) located below the second cover 106*b*. The first and second thermally conductive receptacles 104*a* and 104*b* are sized to receive, completely contain and heat containers containing a product used in sexual activities. The product can be a condom, a personal lubricant, a liquid used in sexual activities or a combination thereof. The first and second covers 106*a* and 106*b* are attached to the housing (e.g., hinge 118 or other means such as sliding along a track or snapping onto a lip, etc.) and disposed over the openings to provide access to the first and second thermally conductive receptacle 104*a* and 104*b* respectively and completely enclose the containers containing the product. As shown, the first cover 106*a* extends to the edges of the housing 102 and the second cover 106*b* is disposed within the first cover 106*b*. Alternatively, the first cover 106*a* can be smaller and disposed within the top of the housing 102, or the second cover 106*b* can be separate and apart from the first cover 106*a*. The first and second covers 106*a* and 106*b* can be insulated to reduce heat loss from the first and second thermally conductive receptacles 104*a* and 104*b*. Moreover, the first and second covers 106*a* and 106*b* can be lockable such that the first and second covers 106*a* and 106*b* cannot be opened whenever the heating element 108 is activated. Note that the first and second covers 106*a* and 106*b* can be integrated into a single cover as shown in FIGS. 15A and 15B. The heating element 108 is disposed within the housing 102 and is connected to the first and second thermally conductive receptacles 104*a* and 104*b*. Alternatively, the heating element 108 can be integrated into the first and second thermally conductive receptacles 104*a* and 104*b*. The temperature sensor 110 is disposed within the housing 102 and connected to the heating element 108, the first thermally conductive receptacle 104*a*, or the second thermally conductive receptacle 104*b*. The temperature sensor 110 can also be integrated into the heating element 108, the first thermally conductive receptacle 104*a* or the second thermally conductive receptacle 104*b*.

The user interface 112 is disposed on a top portion 120 of the housing 102. Alternatively, the user interface 112 can be disposed on a side of the housing 102 or a combination of one or more sides of the housing 102 and the top portion 120. As shown, the user interface 112 includes a visual display screen 122 (e.g., a LCD panel, etc.), a slide switch 124 and a visual status indicator 126 (e.g., LED, light bulb, etc.). The slide switch 124 can have an "on", "off" and "open cover" position. The slide switch 124 can have other positions, such a "low", "medium" and "high" temperature setting. The visual status indicator 126 can signal whether the heating element 108 is activated, the product is sufficiently heated, the power source 116 is low, a malfunction has occurred, etc. The visual display screen 122 can be used to display data, including temperature set points, the actual temperature of the product, text messages, etc. The user interface 112 may also include a speaker (not shown) to provide audible signals, or other buttons, switches, toggle switches, dials, touch screens, etc.

The controller 114, which can be a processor, a printed circuit board, an electrical circuit or other suitable device, is disposed within the housing 102 and is electrically connected to the heating element 108, the temperature sensor 110, and the user interface 112. The controller 114 (a) activates the heating element 108 in response to a signal from the user interface 112 (e.g., slide switch 124), and (b) deactivates the heating element 108 and provides a status indicator via the user interface 112 (e.g., the visual status indicator 126) whenever the temperature sensor 110 indicates a desired temperature of between 80 and 135 degrees Fahrenheit. The status indicator can be visual, audible or a combination thereof. In an alternative embodiment, the controller 114 further (c) deactivates the heating element 108 after a time period regardless of the temperature indicated by the temperature sensor 110. Note that the controller 114 can be a programmable controller via the user interface 112. Moreover, the desired temperature can be adjusted via the user interface 112. The desired temperature of the product is preferably about 98.6 degrees Fahrenheit or within a range of 90 to 115 degrees Fahrenheit. As a result the desired temperature indicated by the temperature sensor 110 may need to be adjusted upward to account for the location and sensitivity of the temperature sensor 110. The power source 116 is disposed within the housing 102 and is connected to the first heating element 108 and the controller 114. Depending on the type of controller 114 used, the power source 116 may also be connected to the temperature sensor 110 or the user interface 112 as indicated by the dashed lines in FIG. 2. The power source 116 may include a battery accessible through battery cover 128, a rechargeable battery, a solar panel, an AC/DC power source accessible through external power connection port 130 or a combination thereof.

The single heating receptacle device 200 can be modified to dispense a liquid heated within a container placed in the thermally conductive receptacle by attaching a dispenser to the housing 102 or within the housing 102. Two examples of such a dispenser will be described in detail with respect to FIGS. 6-7 (detachable dispenser) and FIGS. 18-19 (pivoting dispenser). Briefly, the dispenser includes: (a) a hollow piercing element disposed within the housing 102 proximate to a receptacle opening disposed in a side or bottom of the first thermally conductive receptacle 104*a* such that the piercing element penetrates the container of the product held within the first thermally conductive receptacle 104*a*; (b) a valve removably or pivotably secured to the housing 102 and connected to the hollow piercing element by a passageway; and (c) a valve regulator connected to the valve that controls a flow of the product out of the container, and through the hollow piercing element, the passageway and the valve.

Figure 6:
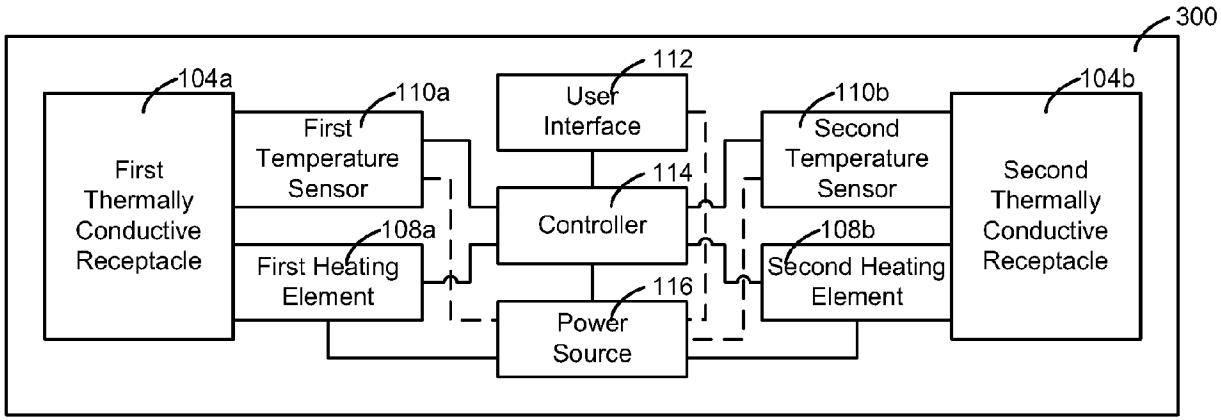
FIG. 6 is a block diagram illustrating the functional elements of the dual receptacle heating device having multiple heating elements in accordance with another embodiment of the present invention.
Figure 5:
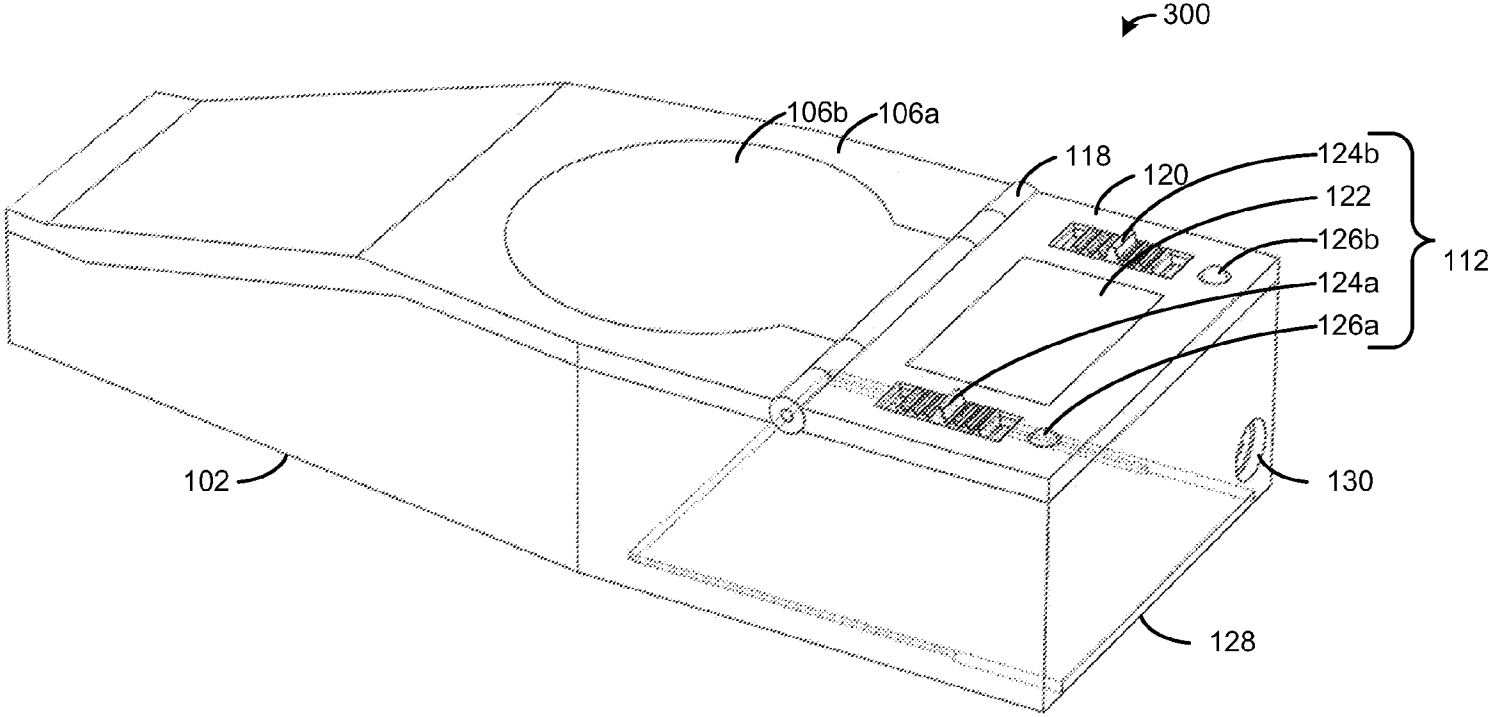
FIG. 5 is a perspective view of a dual receptacle heating device having multiple heating elements in accordance with another embodiment of the invention.

Referring now to FIGS. 5 and 6, a perspective view (FIG. 5) and a block diagram illustrating the functional elements (FIG. 6) of a dual receptacle, dual heating device 300 in accordance with another embodiment of the invention are shown. The heating device 300 includes a housing 102, a first thermally conductive receptacle 104*a*, a second thermally conductive receptacle 104*b*, a first cover 106*a*, a second cover 106*b*, a first heating element 108*a*, a second heating element 108*ba*, a first temperature sensor 110*a*, a second temperature sensor 110*b*, a user interface 112, a controller 114 and a power source 116. The first thermally conductive receptacle 104*a* is disposed within the housing 102 and accessible through an opening (not shown) located below the first cover 106*a*. The second thermally conductive receptacle 104*b* is disposed within the housing 102 and accessible through an opening (not shown) located below the second cover 106*b*. The first and second thermally conductive receptacles 104*a* and 104*b* are sized to receive, completely contain and heat containers containing a product used in sexual activities. The product can be a condom, a personal lubricant, a liquid used in sexual activities or a combination thereof. The first and second covers 106*a* and 106*b* are attached to the housing (e.g., hinge 118 or other means such as sliding along a track or snapping onto a lip, etc.) and disposed over the openings to provide access to the first and second thermally conductive receptacle 104*a* and 104*b* respectively and completely enclose the containers containing the product. As shown, the first cover 106*a* extends to the edges of the housing 102 and the second cover 106*b* is disposed within the first cover 106*b*. Alternatively, the first cover 106*a* can be smaller and disposed within the top of the housing 102, or the second cover 106*b* can be separate and apart from the first cover 106*a*. The first and second covers 106*a* and 106*b* can be insulated to reduce heat loss from the first and second thermally conductive receptacles 104*a* and 104*b*. Moreover, the first and second covers 106*a* and 106*b* can be lockable such that the first and second covers 106*a* and 106*b* cannot be opened whenever the heating element 108 is activated. Note that the first and second covers 106*a* and 106*b* can be integrated into a single cover as shown in FIGS. 15A and 15B. The first heating element 108*a* is disposed within the housing 102 and is connected to the first thermally conductive receptacle 104*a*. The second heating element 108*b* is disposed within the housing 102 and is connected to the second thermally conductive receptacle 104*b*. Alternatively, the first and second heating elements 108*a* and 108*b* can be integrated into the first and second thermally conductive receptacles 104*a* and 104*b*, respectively. The first temperature sensor 110*a* is disposed within the housing 102 and connected to the first heating element 108*a* or the first thermally conductive receptacle 104*a*. The second temperature sensor 110*b* is disposed within the housing 102 and connected to the second heating element 108*b* or the second thermally conductive receptacle 104*b*. The first and second temperature sensors 110*a* and 110*b* can also be integrated into the first and second heating elements 108*a* and 108*b* respectively, or the first and second thermally conductive receptacles 104*a* and 104*b* respectively.

The user interface 112 is disposed on a top portion 120 of the housing 102. Alternatively, the user interface 112 can be disposed on a side of the housing 102 or a combination of one or more sides of the housing 102 and the top portion 120. As shown, the user interface 112 includes a visual display screen 122 (e.g., a LCD panel, etc.), a slide switch 124, and a visual status indicator 126 (e.g., LED, light bulb, etc.), a second slide switch 124*b*, a second visual status indicator 126*b* (e.g., LED, light bulb, etc.). The first slide switch 124*a* and the first visual indicator 126*a* correspond to the first thermally conductive receptacle 104*a*, the first heating element 108*a* and the first temperature sensor 110*a*. The second slide switch 124*b* and the second visual indicator 126*b* correspond to the second thermally conductive receptacle 104*b*, the second heating element 108*b* and the second temperature sensor 110*b*. The first and second slide switches 124*a* and 124*b* can have an "on", "off" and "open cover" position. The first and second slide switches 124*a* and 124*b* can have other positions, such a "low", "medium" and "high" temperature setting. The first and second visual status indicators 126*a* and 126*b* can signal whether the heating element 108 is activated, the product is sufficiently heated, the power source 116 is low, a malfunction has occurred, etc. The visual display screen 122 can be used to display data, including temperature set points, the actual temperature of the product, text messages, etc. The user interface 112 may also include a speaker (not shown) to provide audible signals, or other buttons, switches, toggle switches, dials, touch screens, etc.

The controller 114, which can be a processor, a printed circuit board, an electrical circuit or other suitable device, is disposed within the housing 102 and is electrically connected to the heating element 108, the temperature sensor 110, and the user interface 112. The controller 114 (a) activates the first heating element 108*a* in response to a first signal from the user interface 112 (e.g., first slide switch 124*a*), (b) deactivates the first heating element 108*a* and provides a first status indicator via the user interface 112 (e.g., first visual status indicator 126*a*) whenever the first temperature sensor 110*a* indicates a desired temperature of between 80 and 135 degrees Fahrenheit, (c) activates the second heating element 108*b* in response to a second signal from the user interface 112 (e.g., second slide switch 124*a*), and (d) deactivates the second heating element 108*b* and provides a second status indicator via the user interface 112 (e.g., second visual status indicator 126*b*) whenever the second temperature sensor 110*b* indicates the desired temperature of between 80 and 135 degrees Fahrenheit. The first and second status indicators can be visual, audible or a combination thereof. In an alternative embodiment, the controller 114 further (e) deactivates the first or second heating element 108*a* or 108*b* after a time period regardless of the temperature indicated by the corresponding temperature sensor 110*a* or 110*b*. Note that the controller 114 can be a programmable controller via the user interface 112. Moreover, the desired temperature can be adjusted via the user interface 112. The desired temperature of the product is preferably about 98.6 degrees Fahrenheit or within a range of 90 to 115 degrees Fahrenheit. As a result the desired temperature indicated by the first and second temperature sensors 110*a* and 110*b* may need to be adjusted upward to account for the location and sensitivity of the first and second temperature sensors 110*a* and 110*b*. The power source 116 is disposed within the housing 102 and is connected to the first heating element 108*a*, the second heating element 108*b* and the controller 114. Depending on the type of controller 114 used, the power source 116 may also be connected to the first temperature sensor 110*a*, the second temperature sensor 110*b* or the user interface 112 as indicated by the dashed lines in FIG. 2. The power source 116 may include a battery accessible through battery cover 128, a rechargeable battery, a solar panel, an AC/DC power source accessible through external power connection port 130 or a combination thereof.

Figure 7:
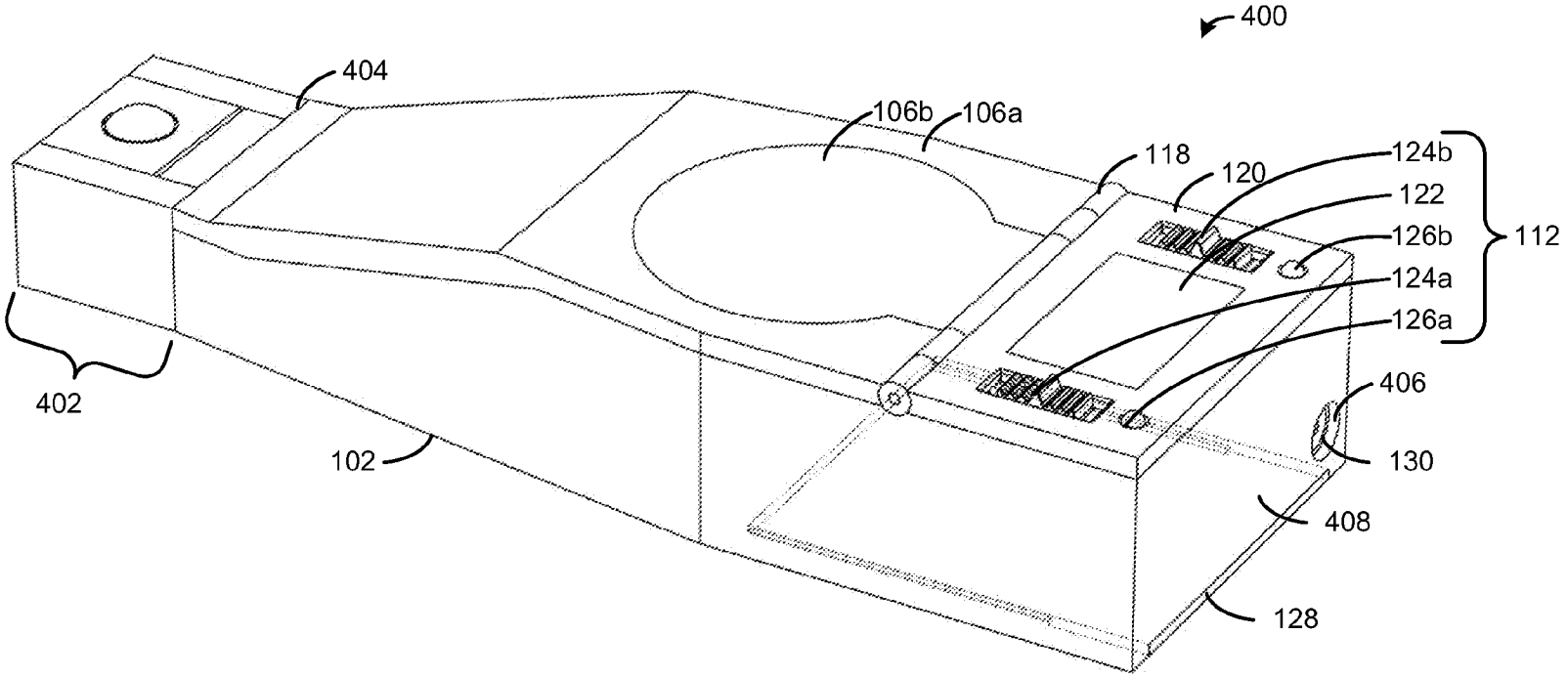
FIG. 7 is a perspective view of a dual receptacle heating device having a fluid dispenser in accordance with yet another embodiment of the invention.

Now referring to FIG. 7, a perspective view of a dual receptacle heating device 400 having a fluid dispenser 402 in accordance with yet another embodiment of the invention is shown. The housing 102 (also referred to as the carriage) includes multiple closures, such as the first cover 106*a* (also referred to as the product warming section cover), the second cover 106*b* (as referred to as the condom lid), and the battery cover 128 (also referred to as the battery section cover) shown in closed positions over the openings in the carriage 102. By opening the product warming section cover 106*a*, condom lid 106*b* or battery section cover 128, the interior of the carriage 102 is accessed exposing components that comprise and support the controlled heating and temperature monitoring assembly wherein the assembly is used to house, heat and monitor and control the temperature of enclosed products. The user interface 112 includes at least one control switch 124 and either or both of the following: at least one LED ready lamp 126 and at least one LCD panel 122 that protrude through openings in the top side 120 of the carriage 102. The drawing shows two control switches 124*a* and 124*b*, two LED ready lamps 126*a* and 126*b* and one LCD panel 122. The control switch 124 is shown to be of the sliding type comprising "on", "off" and "open cover" positions. The switch 124 may comprise more than one "on" position. The control switch is used to power a product heating element, establish a temperature set point and turn off the element. The LED ready lamp 126 signals whether a heating element is activated and, later, whether a product positioned upon the heating element has been sufficiently warmed. The LCD panel 122 displays data, including temperature set points, the actual temperature of a product or text messages. In lieu thereof or in addition to, the carriage 102 may include a speaker that audibly signals activation or sufficient warmth. An opening 406 in the rear wall 408 of the carriage 102 comprises an external power connection port 130. If the device sits in a cradle, the configuration of the external power connection port 130 may be altered. The dispenser 404 (also referred to as the detachable valve assembly) is removably secured to a front end 404 of the carriage 102. The detachable valve assembly 402 dispenses a product warmed in the first thermally conductive receptacle 104*a* (also referred to as a personal lubricant warming tray).

Figure 8:
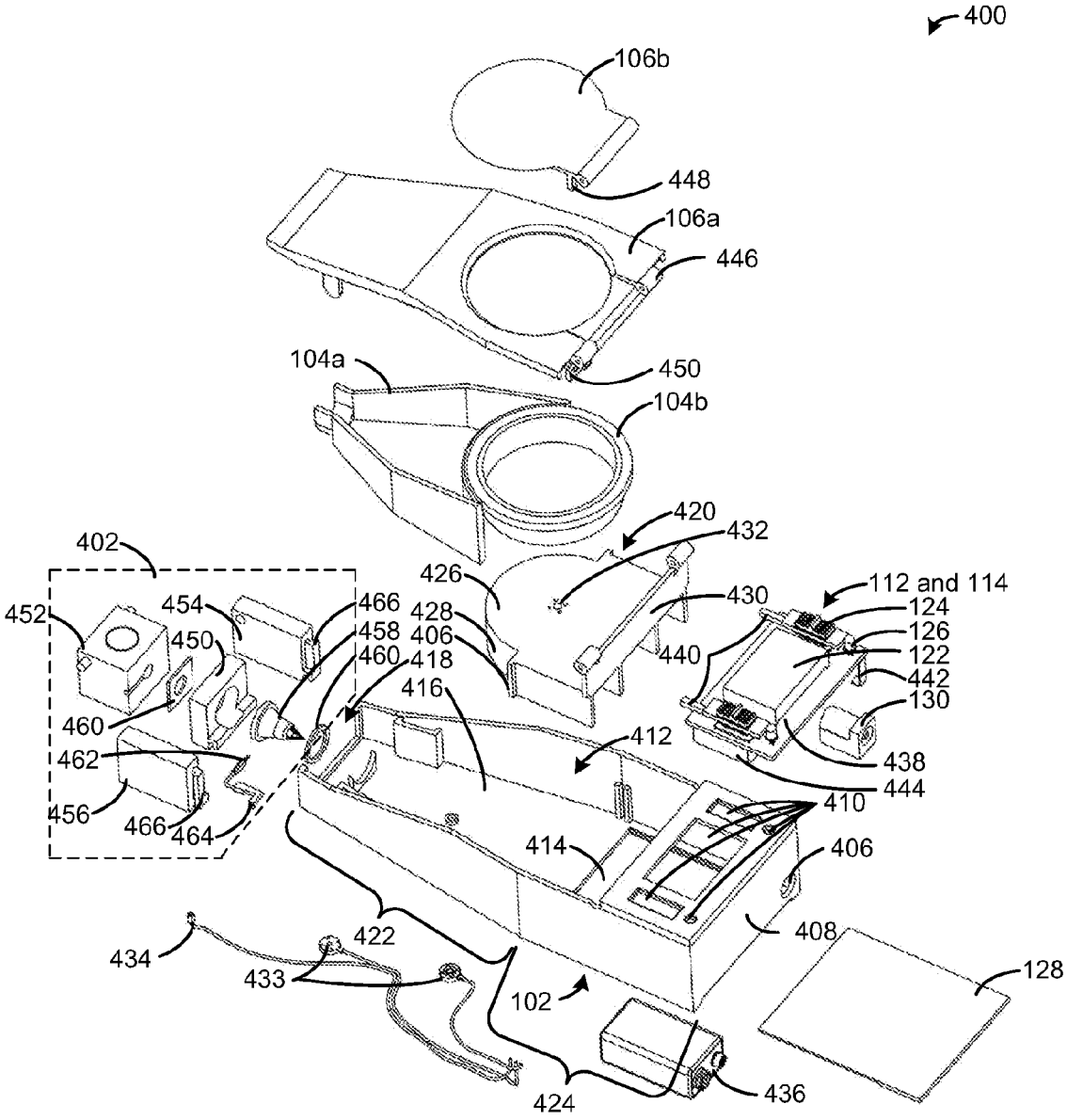
FIG. 8 is an exploded view of the dual receptacle heating device of FIG. 6.

Now referring to FIG. 8, an exploded view of the dual receptacle heating device 400 of FIG. 7 is shown. The device 400 includes the carriage 102, the controlled heating and temperature monitoring assembly and the detachable valve assembly 402. The carriage 102 is shown having (a) openings 410 in the top side 120 to accommodate the user interface 112 and controller 114, (b) an opening 412 in the top side 120 to accommodate the product warming section cover 106*a*, which encloses a condom lid 106*b*, (c) an opening 414 in the bottom wall 416 accommodating a battery section cover 128, (d) an opening 406 in the rear wall 408 accommodating an external power connection port 130 and (e) an opening 418 in the front end 404 of the carriage 102 accommodating the detachable valve assembly 402.

The carriage 102 also includes a section divider 420 housed within the carriage 102 used to support the condom warming tray 104*b* and to divide the interior of the carriage 102 into two sections, the product warming section 422 occupying the proximal end of the carriage 102 (end nearer the valve assembly) and the battery section 424 occupying the distal end (end further from the valve assembly). The section divider 420 is shown to have a base 426, skirt 428 and rear wall 430. The base 426 is flat, curved at its proximal end and comprises an opening 432. The skirt 428 extends down from the edges of the base 426. The rear wall 430 is flat extending up from the distal end of the base 426.

Components comprising the controlled heating and temperature monitoring assembly housed within the carriage 102 include: two product heating elements 108*a* and 108*b*, the personal lubricant warming tray 104*a* and a condom warming tray 104*b*; a controller (printed circuit board) 114, including components thereof; an external power connection port 130; sockets 433 including wiring; a female disconnect 434 including wiring; and at least one battery 436 including a rechargeable battery. The two product heating elements 108*a* and 108*b*, a personal lubricant warming tray 104*a* and a condom warming tray 104*b* are housed within the product warming section 422 of the carriage 102.

The printed circuit board (PCB) 438, including components thereof, an external power connection 128 and a battery 436 are housed within the battery section 424 of the carriage 102. The top side of the PCB 438 includes a user interface 112 shown to comprise two control switches 124, two LED ready lamps 126 and one LCD panel 122. Each control switch 124 may comprise a prong 440 preventing the user from lifting a product warming cover 106*a* when at least one control switch is in an "on" or "off" position. PCB 438 includes embedded components, including an embedded processor, a power control unit, a heater driver, multi-channel A/D and D/A converters, an AC/DC converter, an internal clock, delay timers, an audible indicator and an I/O bus. An external power connection port 130 is connected to PCB 438 with the aid of a PCB connector 442, a component of the PCB 438. An external power connection port 130 includes a nipple that allows a connection with an AC/DC power source. Wiring from the sockets 433 and a female disconnect 434 connect to the PCB 438 with the aid of a terminal block 444, a component of the PCB 438, unless soldered to the PCB 438.

The product warming section cover 106*a* is positioned over the opening 412 in the top side 120 of the carriage 102. A product warming section cover 106*a* is shown enclosing a condom lid 106*b*. By lifting the cover 106*a* along with the enclosed lid 106*b*, both of which are shown to employ the same hinge assembly 446, access is gained to the entire product warming section 424.

The condom lid 106*b* is positioned over a condom warming tray 104*b*. A condom lid 106*b* may be opened and closed independent of the product warming section cover 106*a*. For this purpose the drawing shows the condom lid latch 448 comprising a flanged element positioned on the underside of the lid and a spring loaded element 450 positioned on the rear wall of the product warming section cover 106*a*. Access is gained to the condom warming tray 104*b* by pressing the condom lid thereby activating the lid latch 448.

The battery section cover 128 is shown positioned over the opening 414 in the bottom wall 416 of the carriage 102.

Access is gained to the battery section 422 by removing the cover 128 from the bottom wall 416 of the carriage 102.

The detachable valve assembly 402 is shown to include an anterior section 450, a posterior section 452, a right side section 454, a left side section 456 and a piercing element 458. The front wall of the anterior section 450 comprises a recess into which the piercing element 458 is affixed. The rear wall of the anterior section 450 is adjoined to the front wall of the posterior section 452 the latter section housing a push button, a passageway for the dispensed product and a spout. The right side section 454 and left side section 456 are adjoined to the opposing side walls of an adjoined anterior section 450 and posterior section 452. To avoid leakage, gaskets 460 are employed.

The piercing element 458 is used to impale a container containing a product that is held and warmed in the personal lubricant warming tray 104*a*. It is also used as a conduit through which the product initially flows on its way to the point of discharge. The piercing element 458 may enclose a temperature probe 462 connected by wire to the PCB 438 via a disconnect assembly including a male disconnect 464, a part of the valve assembly, and a female disconnect 434 housed within the carriage 102. The temperature probe 462 measures the actual temperature of a product being heated within the personal lubricant warming tray 104*a*. The temperature probe 462 including wiring and male disconnect 464 comprise parts of the controlled heating and temperature monitoring assembly.

The valve assembly 402 is secured within the opening in the front end 404 of the carriage 102. To secure the valve assembly 402 to the front end 404 of the carriage 102, connecting elements 466 comprising the front wall of an adjoined valve assembly 402 are connected to the front end 404 of the carriage 102.

Figure 9A:
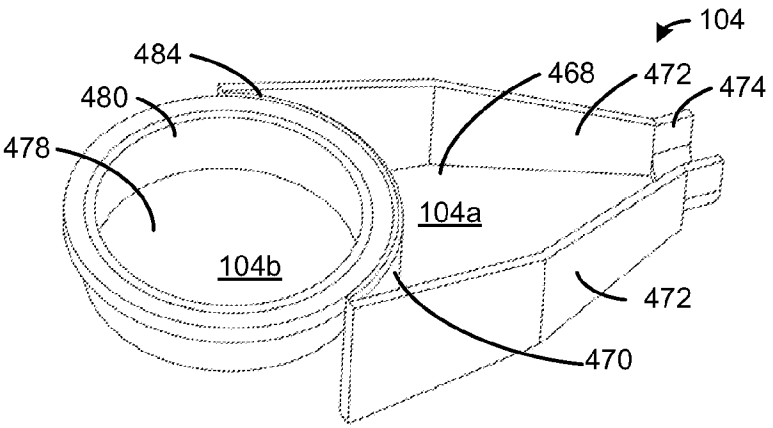
FIGS. 9A and 9B are perspective views of the dual heating receptacles of the heating device of FIG. 7.
Figure 9B:
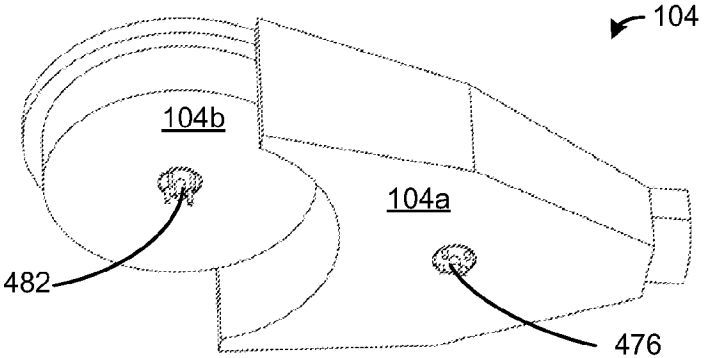

Referring now to FIGS. 9A and 9B, perspective views (top and bottom) of the dual heating receptacles of the heating device of FIG. 7 are shown. Personal lubricant warming tray 104*a* has a floor 468, a rear wall 470, two side walls 472 and an elongated horseshoe-shaped neck 474. The floor is tapered, horizontally positioned and flat. The floor 468 is adjoined to the bottom edges of the rear wall 470, two side walls 472 and the elongated horseshoe-shaped neck 474. The broad end of the floor 468 is curved where it is adjoined to the rear wall 470. The curved rear wall 470 is of equal height and perpendicular to the floor 468. The rear wall 470 and two side walls 472 are adjoined at their vertical edges. The two side walls 472 are perpendicular to the floor 468. The top edge of each side wall 472 extends downward from the rear wall 470 toward the elongated horseshoe-shaped neck 474. The elongated horseshoe-shaped neck 474 is the terminus for the floor 468 and two side walls 472. The underside of a personal lubricant warming tray comprises a first heating element 108*a* plug 476.

The drawing shows a condom warming tray 104*b* having a floor 478 and cylindrical wall 480. The floor 478 is horizontally positioned and flat. The floor 478 is adjoined to the bottom edge of the cylindrical wall 480. The underside of a condom warming tray 104*b* comprises a second heating element 108*b* having a plug 482.

The two product heating elements 60 are shown connected at a common border 484 the span of the border 484 is made of a non-conducting, insulating material to avoid heat transfer from one tray 104*a* to the other 104*b*. The two product heating elements 108*a* and 108*b* may be independent of one another.

Each of the two product heating receptacles 104*a* and 104*b* is constructed of conducting, insulating and sensing materials known in the art. Each warming tray 104*a*, 104*b* includes thermal conductors and a thermal sensing aid, including a thermocouple or thermistor, the conductors and sensing aid wired to prongs that protrude through the underside of each tray forming the plug 476, 482. The plug 476, 482 have four prongs surrounding a post. The plug 476 on the underside of the personal lubricant warming tray 476 is inserted into a socket 433 previously secured within a tray support comprising the floor 416 of the carriage 102. The socket 433 is wired to the PCB 438. The plug 482 on the underside of the condom warming tray 104*b* penetrates an opening 432 in the base of the section divider 420 and is inserted into a socket 433 previously attached to the underside of the base of the section divider 420 below the opening 432. As a result, the personal lubricant warming tray 104*a* and the condom warming tray 104*b* may be powered.

Figure 10A:
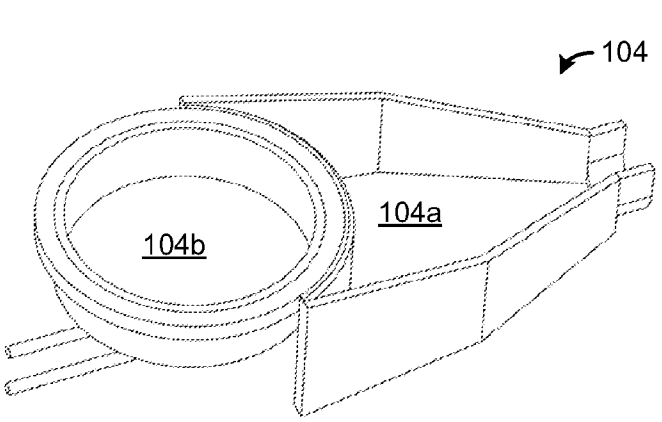
FIGS. 10A and 10B are perspective views of an alternate embodiment the dual heating receptacles of the heating device of FIG. 7.
Figure 10B:
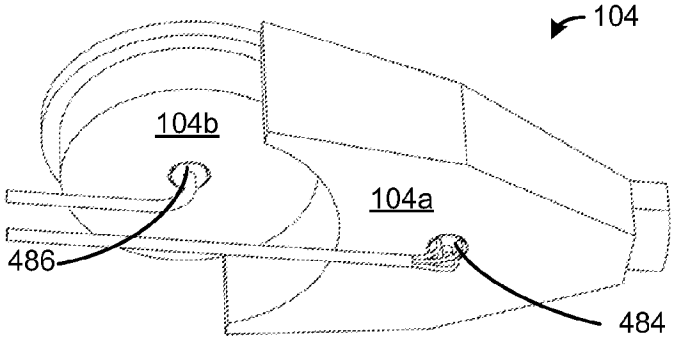

Now referring to FIGS. 10A and 10B, perspective views (top and bottom) of an alternate embodiment the dual heating receptacles of the heating device of FIG. 7 are shown. Each of the two product heating receptacles 104*a* and 104*b* is constructed of conducting, insulating and sensing materials known in the art. Each warming tray 104*a*, 104*b* includes thermal conductors and a thermal sensing aid, including a thermocouple or thermistor, directly connected by wire to the PCB 438. The wires from the conductors and the sensor exit the underside of the personal lubricant warming tray 104*a* and connect to the PCB 438. A post 484 on the underside of the personal lubricant warming tray 104*a* is inserted into the tray support on the floor 416 of the carriage 102 securing the tray. The wires from the thermal conductors and the thermal sensing aid, including a thermocouple or thermistor, comprising the condom warming tray 104*b* exit a cylindrical post 486 on the underside of the condom warming tray 104*b* and connect to the PCB 438. The post 486 penetrates an opening 432 in the base of the section divider 420, wires first, securing the tray to the section divider 420. As a result, the personal lubricant warming tray 104*a* and the condom warming tray 104*b* may be powered. In all other respects each warming tray 104*a*, 104*b* shown in FIGS. 10A and 10B is the same as each warming tray 104*a*, 104*b* shown in FIGS. 9A and 9B.

Figure 11A:
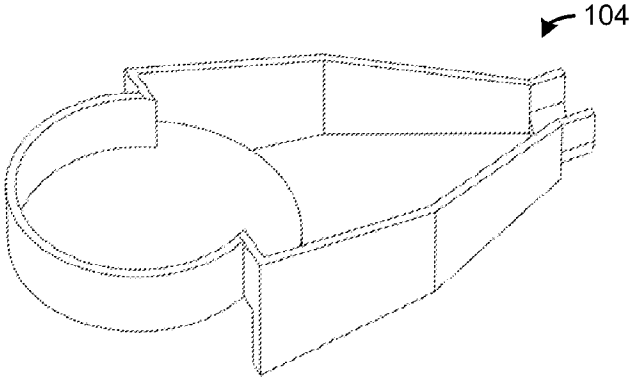
FIGS. 11A and 11B are perspective views of a single heating receptacle usable in yet another embodiment of the heating device.
Figure 11B:
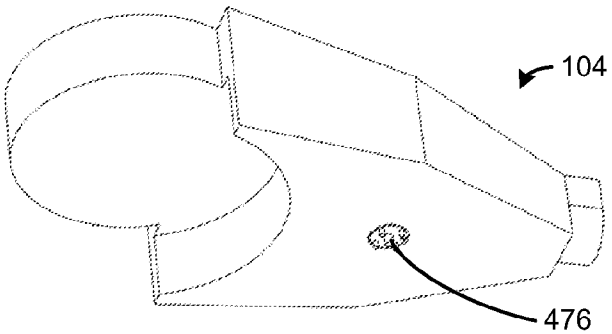

Referring now to FIGS. 11A and 11B, perspective views (top and bottom) of a single heating receptacle usable in yet another embodiment of the heating device are shown. The thermally conductive receptacle 104 is shown to be slipper-shaped occupying the area comprising the product warming section 422 of the carriage 102. The proximal end of this alternate embodiment of the thermally conductive receptacle 104 is substantially similar in shape to the preferred embodiment of the personal lubricant warming tray 104*a*. The distal end of this alternate embodiment of the thermally conductive receptacle 104 is substantially similar in shape to the condom warming tray 104*b* and rests upon the base of the section divider 420. The underside of the thermally conductive receptacle 104 has a heating element plug 476.

The alternate embodiment of the thermally conductive receptacle 104 is constructed of conducting, insulating and sensing materials known in the art. The thermally conductive receptacle 104 includes thermal conductors and a thermal sensing aid, including a thermocouple or thermistor, the conductors and sensing aid wired to prongs that protrude through the underside of the receptacle forming a plug 476. The plug 476 has four prongs surrounding a post. The plug 476 is inserted into a socket 433 previously secured within a tray support on the floor 416 of the carriage 102. The socket 433 is wired to the PCB 438. As a result, thermally conductive receptacle 104 may be powered. Alternatively, thermally conductive receptacle 104 is directly connected by wire to the PCB 438 and a post is inserted into the tray support on the floor 416 of the carriage 102 securing the thermally conductive receptacle 104.

Figure 12:
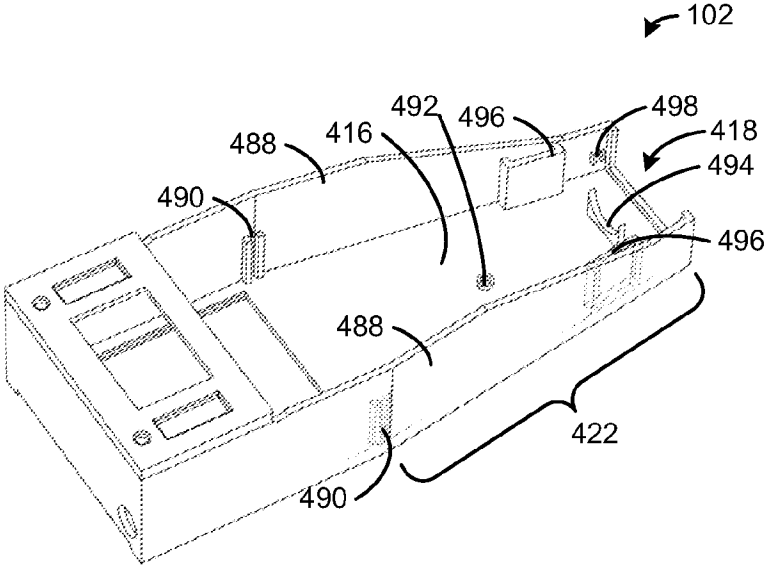
FIG. 12 is a perspective view of the housing of the heating device of FIG. 7.

Now referring to FIG. 12, a perspective view of the housing 102 of the heating device 400 of FIG. 7 prior to adding the section divider 420 is shown. The interior of the carriage 102 includes elements within which the section divider 420 is secured, an element into which a socket or the post comprising the underside of the personal lubricant warming tray 104*a* is inserted, an element used to support and stabilize the personal lubricant warming tray 104*a*, elements used to secure the product warming section cover 106*a* in closed position and an element within which the female disconnect is secured. Within the product warming section 422, the interior side walls 488 have two protruding vertical grooves 490, one on each side, into which the section divider 420 is secured. Within the product warming section 422, the floor 416 of the carriage 102 includes a tray support 492 into which a socket 476 or the post 484 on the underside of the personal lubricant warming tray 104*a* is inserted. Within product warming section 422, the floor 416 of the carriage 102 also includes a raised horseshoe support 494 into which an elongated horseshoe-shaped neck 474 of the personal warming tray 104*a* is inserted for support and stability. Near the proximal end of the product warming section 422, the interior side walls 488 have sleeved closing elements 496, one on each side, into which two flanged closing elements on the underside of the product warming section cover 106*a* are inserted to secure the cover in a closed position. At the proximal end of the product warming section 422, an interior side wall 488 just inside the opening 418 in the front end 404 of the carriage 102 has a holding element 498 within which the female disconnect is secured.

Figure 13:
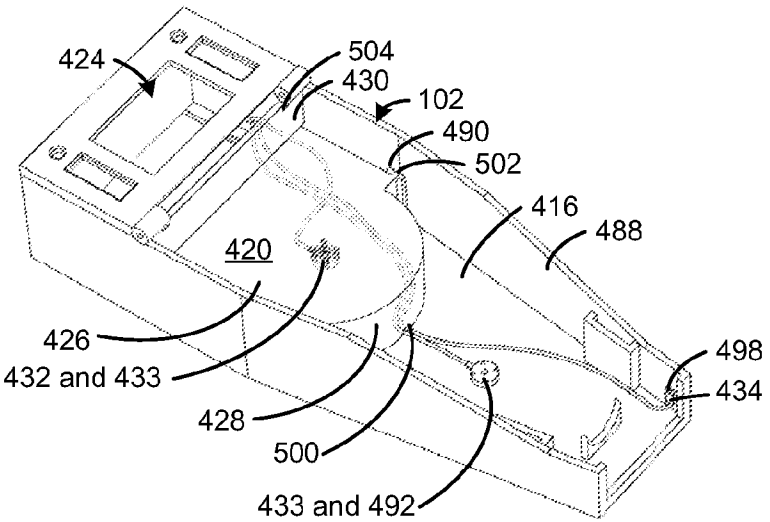
FIG. 13 is a perspective view of the housing of the heating device of FIG. 7 after adding a section divider.

Referring now to FIG. 13, a perspective view of the housing 102 of the heating device 400 of FIG. 7 after securing two sockets 433, the female disconnect 434 and the section divider 420. A socket 433 is secured within the tray support 492 on the floor 416 of the carriage 102. The female disconnect 434 is secured within the holding element 498 on an interior side wall 488 of the carriage 102. The wiring from the socket 433 and female disconnect 434 runs through the opening 500 in the skirt 428 of the section divider 420 to the PCB 438. A second socket 433 is attached to the underside of the base 426 of the section divider 420 below the opening 432 and connected by wire to the PCB 438. In the alternative the two product heating elements are wired directly to the PCB 438 eliminating the need for the sockets 433.

The section divider 420 is added to the carriage 102 by inserting the two runners 502 of the section divider 420, one on each side, into the two protruding vertical grooves 490 on the interior side walls 488 of the housing 102, one on each side. As a result, the interior of the carriage 102 is separated into two sections, the product warming section 422, at the proximal end of the carriage 102, and the battery section 424, at the distal end of the carriage 102. The section divider 420 includes a base 426, skirt 428 and rear wall 430. The base 426 supports the second thermally conductive receptacle 104*b*. The rear wall 430 includes at least one opening 504 corresponding to an opening in a rear wall of the product warming section cover 106*a* through which a prong 440 of the control switch 124 penetrates to prevent the user from lifting the product warming section cover 106*a* when a control switch is in an "on" or "off" position. The drawing shows two openings 504.

Figure 14:
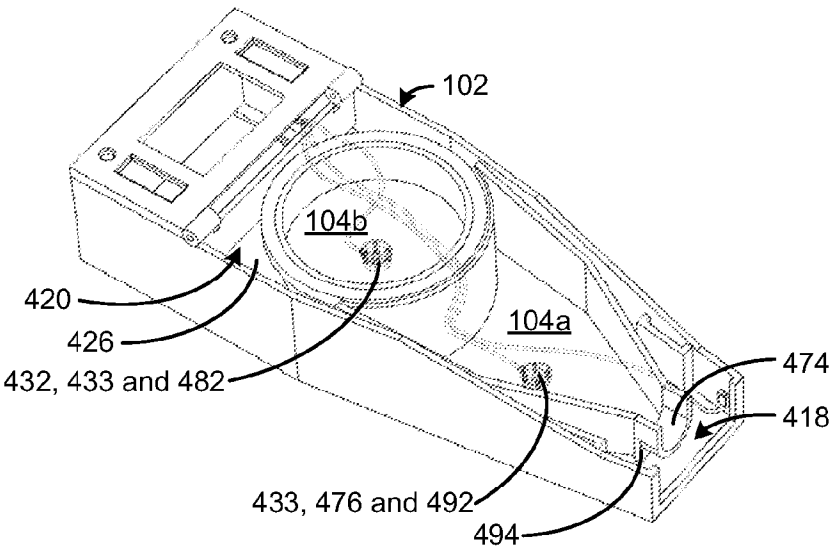
FIG. 14 is a perspective view of the housing of the heating device of FIG. 7 after adding the dual heating receptacles.

Now referring to FIG. 14, a perspective view of the housing 102 of the heating device 400 of FIG. 7 after adding the dual heating receptacles is shown. The personal lubricant warming tray 104*a* is positioned at the proximal end of the product warming section 422. The personal lubricant warming tray 104*a* is secured to the floor 416 of the carriage 102 by inserting the plug 476 the underside of the tray 104 into a socket 433 previously secured within the tray support 492. Alternatively, if the personal lubricant warming tray 104*a* is wired directly to the PCB 438, the tray 104*a* is secured to the floor 416 of the carriage 102 by inserting the post 484 on the underside of the tray 104*a* into the tray support 492. Additional support and stability are achieved when the elongated horseshoe-shaped neck 474 of the personal lubricant warming tray 104*a* is positioned within the horseshoe support 494 on the floor 416 of the carriage 102. The condom warming tray 104*b* is positioned at the distal end of the product warming section 422 atop the base 426 of the section divider 420. The condom warming tray 104*b* is secured to the section divider 420 by inserting the plug 482 on the underside of the tray 104*b* into a second socket 433 attached to the underside of the section divider 420 below the opening 432 in the base 426 of the section divider 420. Alternatively, if the condom warming tray 104*b* is wired directly to the PCB 438, the tray 104*b* is secured to the section divider 420 by inserting the post 486 on the underside of the tray 104*b*, wire first, into the opening 432 in the base 426 of the section divider 420.

Referring now to FIGS. 15A and 15B, perspective views (top and bottom) of a dual cover 106*a* for the dual heating receptacles for the heating device 400 of FIG. 7 are shown. The product warming section cover 106*a* is positioned over the opening 412 in the top side 120 of the carriage 102. The product warming section cover 106*a* includes an opening 506 within which the condom lid 106*b* is otherwise enclosed. By lifting the cover 106*a* along with the enclosed condom lid 106*b* both of which operate using the same hinge assembly 446, access is gained to the entire product warming section 422. The underside of the product warming section cover 106*a* includes an insulating cap 508, constructed of a non-conducting, insulating material, positioned over the personal lubricant warming tray 104*a* when the cover 106*a* is closed reducing heat loss, two flanged closing elements 510, one on each side, used to secure the cover 106*a* in a closed position, a circular rim 512 positioned over the cylindrical edge of the condom warming tray 106*b* when the cover 106*a* is closed avoiding spillage and a rear wall 514 having at least one opening 516 corresponding to an opening 504 in the rear wall 430 of the section divider 420 to allow a prong 440 of the control switch 124 to penetrate and prevent the user from lifting the product warming section cover 106*a* when a control switch 124 is in an "on" or "off" position. The drawing shows two openings 516. The rear wall 514 is the location for one of the two elements comprising the condom lid latch 448, the means that may be used to open and close the condom lid 106*b*.

Figure 16A:
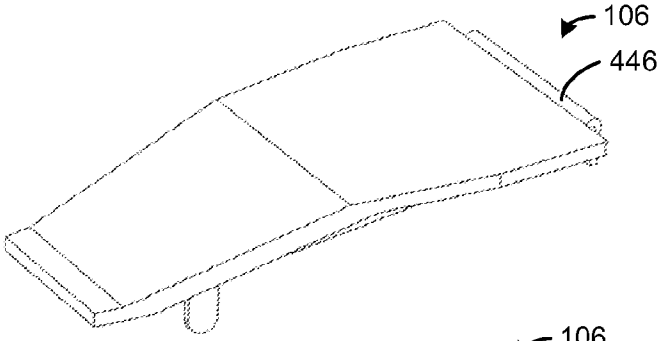
FIGS. 16A and 16B are perspective views of a single cover for the dual heating receptacles for the heating device of FIG. 7.
Figure 16B:
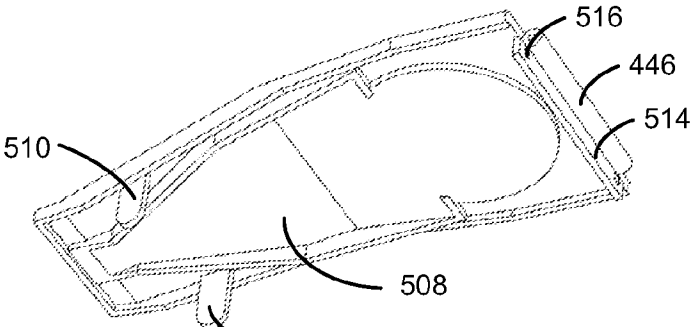

Now referring to FIGS. 16A and 16B, perspective views (top and bottom) of a single cover 106 for the dual heating receptacles for the heating device 400 of FIG. 7 are shown. This embodiment of the cover 106 is positioned over the opening 412 in the top side 120 of the carriage 102 and is lifted and closed with the aid of a hinge assembly 446. By lifting the hinged cover 106, access is gained to the entire product warming section 422. The underside of the cover 106 includes an insulating cap 508 that is positioned over the personal lubricant warming tray 104 when the cover 106 is closed reducing heat loss, two flanged closing elements 510, one on each side, are used to secure the cover 106 in a closed position and a rear wall 514 having at least one opening 516 corresponding to an opening 504 in the rear wall 430 of the section divider 420 to allow a prong 440 of the control switch 124 to penetrate and prevent the user from lifting the product warming section cover 106*a* when a control switch 124 is in an "on" or "off" position. The drawing shows two openings 516.

Figure 17A:
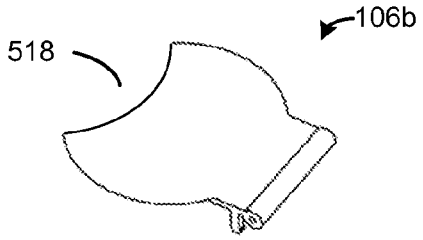
FIGS. 17A and 17B are perspective views of two alternative embodiments of a second cover for using in the dual cover of FIGS. 15A and 15B.
Figure 17B:
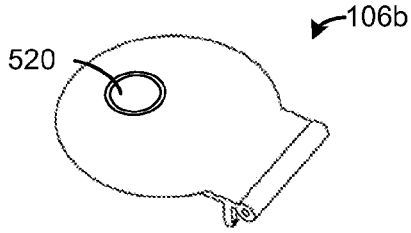

Referring now to FIGS. 17A and 17B, perspective views (top and bottom) of two alternative embodiments of a second cover 106*b* for using in the dual cover of FIGS. 15A and 15B are shown. The first alternate embodiment (FIG. 17A) of the condom lid 106*b* includes an opening 518 in the top of the lid 106*b*. A digit of the hand may be inserted through the opening 518 for the purpose of applying pressure to the receptacle housed below within the condom warming tray 104*b* thereby activating a heat-generating element enclosed within the receptacle causing an exothermic event warming the enclosed product. The second alternate embodiment (FIG. 17B) of the condom lid 106*b* includes a spring-loaded plunger 520 positioned within an opening in the top of the lid 106*b*. When the spring-loaded plunger 520 is depressed pressure is applied to the receptacle housed within the condom warming tray 104*b* thereby activating a heat-generating element enclosed within the receptacle causing an exothermic event warming the enclosed product.

Figure 18:
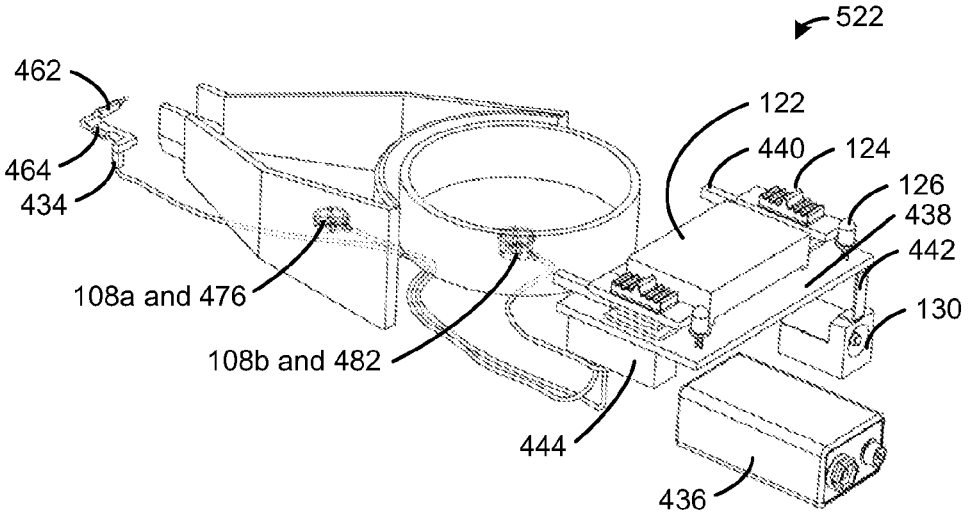
FIG. 18 is a perspective view of the controlled heating and temperature monitoring assembly of the heating device of FIG. 7.

Now referring to FIG. 18, a perspective view of the controlled heating and temperature monitoring assembly of the heating device 400 of FIG. 7 is shown. The controlled heating and temperature monitoring assembly 522 includes: the two product heating elements 108*a* and 108*b*, the personal lubricant warming tray 104*a* and condom warming tray 104*b*; the PCB 438, including components thereof; an external power connection port 130; two sockets including wiring 432; and at least one battery 436, which can be a rechargeable battery. The controlled heating and temperature monitoring assembly 522 may include a temperature probe 462 and a disconnect assembly including a male disconnect 464 and female disconnect 433 including wiring.

The personal lubricant warming tray 104*a* and the condom warming tray 104*b* each comprise thermal conductors and a thermal sensing aid, including a thermocouple or thermistor, said conductors and sensing aid wired to prongs that protrude through the underside of each tray forming a plug 476, 482. The plug 476, 482 include four prongs surrounding a post. The 476 plug on the underside of the personal lubricant warming tray 104*a* is inserted into a socket 433 previously secured within a tray support on the floor 416 of the carriage 102. The socket 433 is wired to the PCB 438. If the personal lubricant warming tray 104*a* and the condom warming tray 104*b* are wired directly to the PCB 438 the need for the sockets 433 is eliminated.

The top side of the PCB 438 includes the user interface 112 including at least one control switch 124 and, preferably either or both of the following: at least one LED ready lamp 126 and at least one LCD panel 122. The drawing shows two control switches 124, two LED ready lamps 126 and one LCD panel 122. The PCB 438 includes embedded components, including an embedded processor, a power control unit, a heater driver, multi-channel A/D and D/A converters, an AC/DC converter, an internal clock, delay timers, an audible indicator and an I/O bus. The underside of the PCB 438 includes a terminal block 444 into which wires leading from the sockets 433 and the female disconnect 434 are connected unless soldered to the PCB 438. A PCB connector 442 connects the PCB 438 to an external power connection 130. The external power connection 130 includes a nipple that allows a connection with an AC/DC power source.

The controlled heating and temperature monitoring assembly 522 may include a temperature probe 462 enclosed within the piercing element 458 of the detachable valve assembly 402. The probe 462 is connected by wire to the PCB 438 via a disconnect assembly. The temperature probe 462 measures the actual temperature of a product being heated within the personal lubricant warming tray 104*a*.

Figure 19:
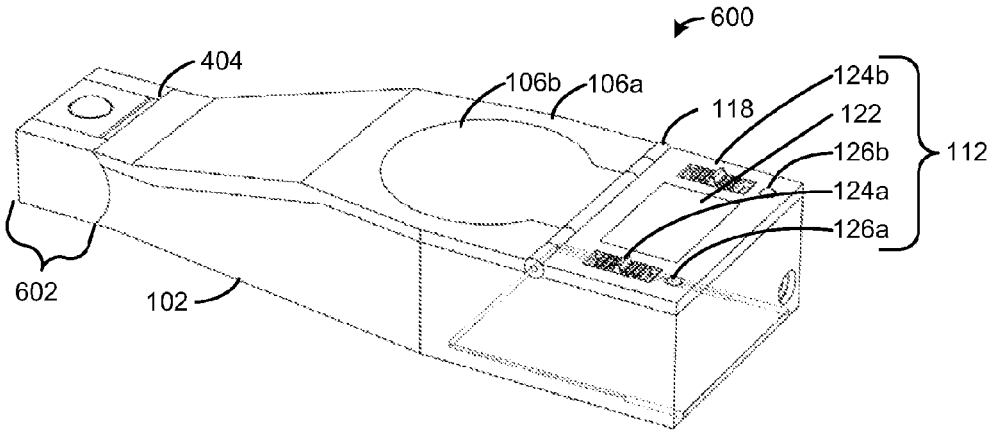
FIG. 19 is a perspective view of a dual receptacle heating device having a pivoting fluid dispenser in accordance with yet another embodiment of the invention.

Referring now to FIG. 19, a perspective view of a dual receptacle heating device 600 having a pivoting or rotating fluid dispenser 602 in accordance with yet another embodiment of the invention is shown. The heating device 600 includes a carriage 102 and the pivoting or rotating valve assembly 602. The pivoting rotating valve assembly 602 is secured to a front end 404 of the carriage 102. The rotating valve assembly 602 dispenses an enclosed product warmed in the personal lubricant warming tray. Except for the pivoting or rotating valve assembly 602, the heating device 600 is basically the same as the heating device 400 described in reference to FIGS. 7-18.

Figure 20:
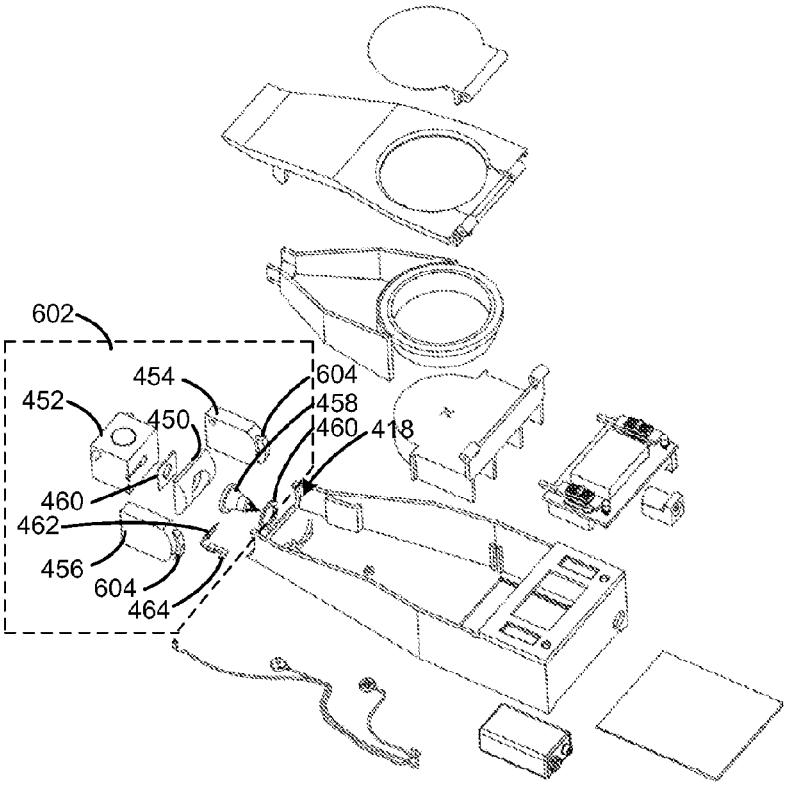
FIG. 20 is an exploded view of the dual receptacle heating device of FIG. 19.

Now referring to FIG. 20, an exploded view of the dual receptacle heating device 600 of FIG. 19 is shown. Except for the pivoting or rotating valve assembly 602, the heating device 600 is the basically same as the heating device 400 described in reference to FIGS. 7-18. For example, the carriage 102 houses the same mechanical and electrical components and comprises the same elements as the carriage 102 of device 400 with the following exceptions. An opening 418 in the front end 404 of the carriage 102 is configured to accommodate the pivoting or rotating valve assembly 602.

The rotating valve assembly 602 is shown to comprise an anterior section 450, a posterior section 452, a right side section 454, a left side section 456 and a piercing element 458. The rear wall of the anterior section 450 is adjoined to the front wall of the posterior section 452 the latter section housing a push button, a passageway for the dispensed product and a spout. The right side section and left side section are adjoined to the opposing side walls of an adjoined anterior section 450 and posterior section 452. To avoid leakage, gaskets 460 are employed.

The front wall of the anterior section 450 comprises a recess into which the piercing element 458 is affixed. The piercing element 458 is used to impale a compartment containing a product that is held and warmed in the personal lubricant warming tray 104*a*. It is also used as a conduit through which the product initially flows on its way to the point of discharge. The piercing element 458 may enclose a temperature probe 462 connected by wire to the PCB 438. The temperature probe 462 measures the actual temperature of a product being heated within the personal lubricant warming tray 104*a*. The temperature probe 462 may be wired directly to the PCB 438 as shown in the drawing or wired to the PCB 438 with the aid of a disconnect assembly. If the temperature probe 462 is wired directly to the PCB 438, the front wall of the adjoined valve assembly 602 would comprise an opening through which the wire is run. The temperature probe 462, wiring and any disconnect assembly comprise parts of the controlled heating and temperature monitoring assembly 522.

The rotating valve assembly 602 is secured within the opening in the front end 404 of the carriage 102. The front wall of an adjoined valve assembly 602 comprises curved connecting elements 604, one on each side, extending from top to bottom. The front end 404 of the carriage 102 comprises curved connecting elements 604, one on each side, extending from top to bottom. To secure the rotating valve assembly 602 to the front end 404 of the carriage 102, connecting elements 604 on the front wall of the adjoined valve assembly are connected to connecting elements comprising the front end 404 of the carriage 102. Although secured to the carriage 102, the valve assembly 602 may be rotated upward allowing the piercing element 458 to rise to an angle to accommodate the impaling of a compartment containing a product that is held and warmed in the personal lubricant warming tray 104*a*.

The assembly of the condom and personal lubricant warming and dispensing device 400 will now be described. The device 400 comprises the carriage 102, the controlled heating and temperature monitoring assembly 522 and the detachable valve assembly 402 or 602. The carriage 102 houses components comprising and supporting the controlled heating and temperature monitoring assembly 522. The detachable valve assembly 402 is attached to the front end 404 of the carriage 102 resulting in a working device and dispenses compartmentalized product that is housed and heated within the personal lubricant warming tray 104*a*.

The carriage 102, excluding the closures and section divider, is manufactured as a single piece. The interior of the carriage 102 comprises numerous elements. The opposing interior side walls comprise two vertical grooved elements 490, one on each side, into which the section divider 424, a part of the carriage 102, is placed. Within the product warming section 424, the floor 416 of the carriage 102 comprises a tray support 492 into which a socket including wiring 433 or the post comprising the underside of the personal lubricant warming tray 464 is inserted. The floor of the carriage 102 comprises a horseshoe support 494 into which the elongated horseshoe-shaped neck comprising the personal lubricant warming tray 104*a* is positioned for support and stability. At the proximal end of the product warming section 424, an interior side wall 488 just inside the opening in the front end 404 of the carriage 102 comprises a holding element 498 within which the female disconnect including wiring 433 is secured.

The carriage 102 comprises other elements that accommodate the closing of the product warming section cover 106*a* and the removal and re-attachment of the battery section cover 128. Near the proximal end of the product warming section the interior side walls comprise sleeved closing elements 488, one on each side, into which the two flanged closing elements 510 on the underside of the product warming section cover 106*a* are inserted to secure the cover 106*a* in a closed position. The battery section cover 128 is positioned over the opening in the bottom wall 416 of the carriage 102. The bottom wall 416 of the carriage 102 includes elements that accommodate the removal or re-attachment of the battery section cover 128.

The carriage 102 is shown having (a) openings 410 in the top side 120 to accommodate the user interface 112 and controller 114, (b) an opening 412 in the top side 120 to accommodate the product warming section cover 106*a*, which encloses a condom lid 106*b*, (c) an opening 414 in the bottom wall 416 accommodating a battery section cover 128, (d) an opening 406 in the rear wall 408 accommodating an external power connection port 130 and (e) an opening 418 in the front end 404 of the carriage 102 accommodating the detachable valve assembly 402.

The process of assembling begins with installing electrical components comprising the controlled heating and temperature monitoring assembly 522 within the carriage 102. First, the PCB 438 is secured to the underside of the top side 120 of the carriage 102 within the battery section 424. The user interface control panel 122, including at least one control switch 124 and, preferably, either or both of the following: at least one LED ready lamp 126 and at least one LCD panel 122, protrudes through openings 410 in the top side 120 of the carriage 102. The drawing shows two control switches 124, two LED ready lamps 126 and one LCD panel 122. The underside of the PCB comprises a terminal block 444 into which wires from components comprising the controlled heating and temperature monitoring assembly 522 are inserted unless soldered to the PCB 438. The PCB 438 comprises the PCB connector 442 that connects the PCB to the external power connection 130. The external power connection 130 includes a nipple that allows a connection with an AC/DC power source. The at least one battery 436 is positioned beneath the PCB 438.

Assembly continues with the installation of two sockets including wiring 433, the female disconnect including wiring 434 and the section divider 420. A first socket 433 is secured within the tray support 492. The female disconnect 434 is secured within the holding element 498. A second socket 433 is attached to the underside of the base of the section divider 426 below the opening in the base 432. The section divider 420 is then secured to the interior side walls 488 of the carriage 102 by inserting the two protruding runners comprising the section divider 502, one on each side, into the two protruding vertical grooved elements comprising the interior side walls 490 of the carriage 102, one on each side. The section divider 420 includes an opening 504 in the skirt 428 through which wires leading from the first socket and the female disconnect 433 are run and subsequently connected to the PCB 438 with the aid of the terminal block 444 unless soldered to the PCB 438. The second socket 433 is connected by wire to the PCB 438. If the personal lubricant warming tray 104*a* and the condom warming tray 104*b* are wired directly to the PCB 438, the installation of the sockets 433 is not necessary.

Next, the two product heating elements 108*a* and 108*b* are installed. The personal lubricant warming tray 104*a* is positioned at the proximal end of the product warming section 424 while the condom warming tray 104*b* is positioned at the distal end. The personal lubricant warming tray 104*a* is secured to the floor 416 of the carriage 102 by inserting the plug 476 comprising the underside of the tray into a socket 433 previously secured within the tray support 492. Alternatively, if the personal lubricant warming tray 104*a* is wired directly to the PCB, the tray 104*a* is secured to the floor 416 of the carriage 102 by inserting the post 464 on the underside of the tray 464 into the tray support 492 after the wires are inserted through the opening 504 in the skirt 428 of the section divider 420. Additional support and stability are achieved when the elongated horseshoe-shaped neck comprising the personal lubricant warming tray 104*a* is positioned within the horseshoe support 494 on the floor 416 of the carriage 102. The condom warming tray 104*b* is secured to the section divider 420 by inserting the plug 482 on the underside of the tray through the opening 432 in the base 426 and into a second socket 433 attached to the underside of the base of the section divider 420 below the opening 432. Alternatively, if the condom warming tray 104*b* is wired directly to the PCB 438, the tray 104*b* is secured to the section divider 420 by inserting the post 486 comprising the underside of the tray, wire first, through the opening 432 in the base 426. In lieu of installing two product heating elements within the product warming section 104*a* of the carriage 102, a single product heating element may be installed within the carriage 102.

Assembly of the carriage 102 is completed with the addition of the product warming section cover 106*a* and battery cover 128. The product warming section cover 106*a* is installed over an opening 412 in the top wall of the carriage 102 using the hinge assembly 446. The preferred embodiment of the product warming section cover 106*a* encloses the condom lid 106*b*, 102, 104. The underside of the cover 106*a* comprises an insulating cap 508 that is positioned over the personal lubricant warming tray 104*a* when the cover 106*a* is closed reducing heat loss. The cap 508 is attached to the underside of the cover using any means known in the art. The underside of the cover 106*a* includes other elements, including a circular rim 512 positioned over the cylindrical edge of the condom warming tray 104*b* when the cover 106*a* is closed avoiding spillage, two flanged closing elements 510, one on each side, used to secure the cover 106*a* in a closed position and a rear wall 514 at the distal end of the cover. The condom lid 106*b*, 102, 104 is installed over the condom warming tray 104*b* using the hinge assembly 446. When the condom lid 106*b*, 102, 104 is closed, it is held in place by a locking mechanism, including a condom lid latch 498 made up two elements, an element comprising the underside of the lid and an element positioned on the rear wall of the product warming section cover 106. The battery section cover 128 is installed within the opening in the bottom wall 416 of the carriage 102 by any means known in the art. If a single product heating element is installed within the product warming section 104*a* of the carriage 102, the alternate embodiment of the product warming section cover is installed over an opening 412 in the top wall of the carriage 102.

The device 400 may be partially disassembled to accommodate cleaning the interior of the carriage 102. Disassembly is accomplished by removing one or both of the product heating elements 104*a*, 104*b* and the section divider 420.

Next, the valve assembly 402 is assembled. The valve assembly 402 includes an anterior section 450, a posterior section 452, a right side section 454, a left side section 456, a piercing element 458 and electrical components. The rear wall of the anterior section 450 is adjoined to the front wall of the posterior section 452 the latter section housing a push button, a passageway for the dispensed product and a spout. The right side section 454 and left side section 456 are adjoined to the opposing side walls of an adjoined anterior section 450 and posterior section 452. To avoid leakage, gaskets 460 are used. Any means known in the art may be used to adjoin the various parts.

The front wall of the anterior section 450 comprises a recess into which the piercing element 458 is affixed. The piercing element 458 encloses a temperature probe 462 that is wired to the PCB 438 with the aid of a disconnect assembly made up of a male disconnect comprising the valve assembly 464 and a female disconnect including wiring 433 secured within the holding element 498.

Finally, the device 400 is totally assembled when the valve assembly 402 is removably secured within the opening to the front end 404 of the carriage 102. To secure the valve assembly 402 to the front end 404 of the carriage 102, connecting elements 466 on the front wall of the anterior section of the valve assembly are connected to connecting elements on the front end 404 of the carriage 102.

The operating the condom and personal lubricant warming and dispensing device 400 will now be described. The device 400 is powered by a non-mechanical energy source, including a battery, rechargeable battery, or AC/DC power source. Although the battery may be insufficiently charged, the device 400 may be operated using the AC/DC power source, including a plug-in AC/DC power supply adaptor. For this purpose, the device 400 comprises the external power connection 130 located within the battery section 4242. The external power connection 130 is connected to the PCB 438 via the PCB connector 127. The external power source is inserted into the external power connection port 130 and onto a nipple. The device 400 may sit in a cradle where it is charged. The use of a cradle may require that the configuration of the external power connection port 130 is altered.

The top side 120 of the carriage 102 is shown to comprise a user interface control panel 122. The user interface control panel 122 is shown to include two control switches 124, two LED ready lamps 126 and one LCD panel 122. The control switch 124 is shown to be of the sliding type comprising "on", "off" and "open cover" positions. The switch 124 may comprise more than one "on" position. The control switch is used to power a product heating element, establish a temperature set point and turn off the element. A LED ready lamp 126 signals whether a heating element or elements are activated and, later, whether an enclosed product or products have been sufficiently warmed. The LCD panel 122 displays data, including temperature set points, the actual temperature of a compartmentalized product or text messages. In lieu thereof or in addition to, a PCB may comprise an embedded component that audibly signals activation or sufficient warmth. An opening 406 in the rear wall 408 of the carriage 102 comprises an external power connection port 130 into which an AC/DC power source is inserted.

The electronics should operate in the following manner if a temperature probe 462 is not used to determine whether an enclosed product positioned and heated within a heating element 104*a*, 104*b* is sufficiently warmed. Upon inserting the battery within the device 400 or otherwise making power available, the embedded processor, a component of the PCB 438, is initialized and waits in an idle state until either or both of the control switches 124 are turned on. When a control switch 124 controlling a heating element 104*a*, 104*b*, 77 is turned on and a temperature set point established, the embedded processor briefly illuminates the appropriate LED ready lamp 126, starts a safety cutoff timer and reads and stores the temperature set point. The embedded processor compares the temperature set point to the temperature of the heating element measured by the thermal sensing aid. If the temperature of the heating element is below the temperature set point, the embedded processor powers the heating element and the LED ready lamp 126 remains off. If the temperature of the heating element at or above the temperature set point, the embedded processor either modulates the voltage level adjusting the temperature of the heating element to the set point or power to the heating element is discontinued, reducing battery strain. The modulation or discontinuance of power to the heating element is accomplished with the aid of the power control unit, a component of the PCB 438. The LED ready lamp 126 will illuminate as the temperature set point has been reached even though the temperature of the enclosed product lags that of the heating element. The LED ready lamp 126 will remain illuminated until the control switch 124 is slide to the "off" position or the safety cutoff timer expires. LCD panel 122 may display numeral data or text messages. Other means known in the art may be used to indicate when an enclosed product has been sufficiently warmed.

As mentioned in the above paragraph, although the LED ready lamp 126 will illuminate when the heating element reaches the temperature set point, the actual temperature of the enclosed product lags that of the heating element. The LED ready lamp 126 may be programmed to illuminate only after a set period of time has elapsed ensuring that the actual temperature of the enclosed product will be closer to the temperature set point. This may be accomplished by decrementing a LED ready lamp timer to an internal reference clock. The LED ready lamp timer may be initiated at the time a control switch 124 controlling a heating element is turned on or at the time the heating element reaches the temperature set point.

The electronics should operate in the following manner if a temperature probe 462 is used to determine whether an enclosed product positioned and heated within a heating element 104*a* is sufficiently warmed. Upon inserting the battery within the device 400 or otherwise making power available, the embedded processor is initialized and waits in an idle state until the switch 124 controlling the personal lubricant warming tray 104*a* is slide to the "on" position. When the control switch 124 controlling the heating element 104*a* is turned on and a temperature set point established, the embedded processor briefly illuminates the appropriate LED ready lamp 126, starts a safety cutoff timer and reads and stores the temperature set point. The embedded processor compares the temperature set point to the temperature of the heating element measured by the thermal sensor. If the temperature of the heating element is below the temperature set point, the embedded processor powers the heating element and the LED ready lamp 126 remains off. If the temperature of the heating element is above the temperature set point, the embedded processor modulates the voltage level and adjusts the temperature of the heating element to the set point with the aid of the power control unit. Although the temperature of the heating element is at set point, the LED ready lamp 126 will not illuminate as the temperature of the enclosed product lags that of the heating element. The LED ready lamp 126 will illuminate after the embedded processor reads the temperature of the enclosed product using the temperature probe 462 indicating the enclosed product has been sufficiently warmed. The LED ready lamp 126 will remain illuminated until the control switch 124 is slide to the "off" position or the safety cutoff timer expires. The power to the heating element may be discontinued when the LED ready lamp 126 illuminates, reducing battery strain. The LED ready lamp 126 will remain illuminated until the control switch 124 is turned to the "off" position or the safety cutoff timer expires. LCD panel 122 may display numeral data or text messages. Other means known in the art may be used to indicate when an enclosed product has been sufficiently warmed.

The process of powering the heating element 104*a*, 104*b* requires the embedded processor to send and receive digital binary signals. The embedded processor sends digital binary signals across a digital I/O bus to a multi-channel D/A converter that translates the binary signals into analog voltage levels. Then, the embedded processor receives digital binary signals across the digital I/O bus from a multi-channel A/D converter that translates analog voltage levels to digital binary signals. The embedded processor will make the necessary power level adjustments to the heating element 104*a*, 104*b* based upon a temperature reading of the thermal sensing aids.

The device 400 comprises built-in safeguards. Each control switch 124 comprises a prong 440 that penetrates corresponding openings in the rear wall 430 of the section divider 420 and the rear wall of the product warming section cover 514 preventing the user from lifting the product warming section cover 106*a* when at least one control switch 124 is in the on or off position. Upon advancing all control switches 124 to the open cover position, the prongs slide free of the locking position, allowing the user to lift the product warming section cover 106*a* and replace a depleted compartment or compartments. When a control switch 124 is moved from the on position to the off position, power to the heating element 104*a*, 104*b* is shut off. The device 400 is automatically turned off by the embedded processor if a control switch 124 is left in the on position for an excessive time period, for example, 20 minutes. In determining whether the time period has elapsed, the embedded processor decrements a safety cutoff timer by comparing it to an internal reference timer clock. Once the device 400 is off, the embedded processor waits in an idle state until the device is again turned on.

The device 400 may comprise an alternate embodiment of the condom lid 106*b* facilitating the heating of a compartmentalized product positioned within the condom warming using exothermic means rather than electrical means. The first alternate embodiment of the condom lid 106*a* comprises an opening 518 in the top of the lid. A digit of the hand may be inserted through the opening 518 for the purpose of applying pressure to the receptacle housed below within the condom warming tray 104*b* thereby activating a heat-generating element enclosed within the receptacle causing an exothermic event warming the enclosed product. The second alternate embodiment of the condom lid 106*b* comprises a spring-loaded plunger 520 positioned within an opening in the top of the lid. When the spring-loaded plunger 520 is depressed pressure is applied to the receptacle housed within the condom warming tray 104*b* thereby activating a heat-generating element enclosed within the receptacle causing an exothermic event warming the enclosed product.

Discharging or removing compartmentalized products held and warmed within the device 400 will now be described. Compartmentalized products are housed and warmed within the heating elements 104*a*, 104*b*. To position a compartmentalized product within one or both heating elements, the product warming section cover 106*a* is lifted exposing the trays. To lift the cover 106*a*, the user must first advance all control switches 124 to the open cover position. The valve assembly 402 is detached from the front end 404 of the carriage 102. The piercing element 458 comprising the valve assembly 402 is used to impale a compartment containing product to be positioned within the personal lubricant warming tray 104*a*. The valve assembly 402 is re-attached to the front end 404 of the carriage 102, and the impaled compartment positioned within the personal lubricant warming tray 104*a*. The impaled compartment may be connected to another compartment containing a product that is simultaneously positioned within the condom warming tray 104*b*. Otherwise, a second compartment containing product may be positioned within the condom warming tray 104*b* independent of the impaled first compartment. The product warming section cover 106*a* is then closed and the control switch or switches 124 returned to the off position.

The compartmentalized product, presumably personal lubricant, positioned within the personal lubricant warming tray 104*a* is discharged by activating the valve assembly 402. The compartmentalized product, presumably at least one condom immersed in personal lubricant, positioned within the condom warming tray 104*b* is removed manually. The user depresses the condom lid 106*b* activating the lid latch 498 causing the lid to rise exposing the compartment containing the product. The product may then be removed. Preferably, the compartment may be resealed to avoid the possibility of spillage. Notwithstanding, the device 400 comprises safeguards to prevent the migration of liquid from a opened compartment housed in the condom warming tray 104*b* into the interior of the carriage 102. First, the underside the product warming section cover comprises a circular rim 512 surrounding the opening to the condom warming tray and positioned over the cylindrical edge of the condom warming tray 104*b* when the cover 106*a* is closed avoiding spillage into the interior of the carriage 102. Second, the section divider 420 fits snugly against the interior side walls 488 and floor 416 of the carriage 102 preventing the migration of any spilled liquid from the product warming section 424 into the battery section 52.

Note that the assembly, operation and removal of products from the other embodiments of the present invention (e.g., devices 100, 200, 300 and 600) are similar to that described above in reference to device 400

Although the description above contains much specificity, it should not be construed as limiting the scope of the invention but merely providing illustrations of some of the embodiments of this invention. For example, the design and shape of the condom and personal lubricant warming and dispensing device and the design, shape, and location of its components, including the elements comprising the components, are not limited to the designs, shapes, and locations shown in the drawings. The heating elements 104*a*, 104*b* may be constructed of any material known in the art that will serve to appropriately warm the enclosed products to the desired temperatures. The temperatures of the heating elements 104*a*, 104*b* or the product being heated may be monitored with the aid of thermal sensing aids, including thermocouples, thermistors, a temperature probe or any other thermal sensing aids known in the art. The PCB 438 may comprise various components, including an embedded component that audibly signals activation or sufficient warmth. Any means known in the art may be employed to open and close the product warming section cover 106*a* the condom lid 106*b*, 102, 104 or battery section cover 128. The valve assembly 402, 260 may be detachable from, or affixed to, the carriage 102 and may comprise a thermal sensing aid, such as a temperature probe 462, that is wired directly to the PCB 438 or with the aid of a disconnect assembly. The invention may employ Bluetooth technology or other wireless technology to communicate with, or activate, the device.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification, but only by the claims.

The invention claimed is:

1. A heating device comprising:

a housing;

a thermally conductive receptacle disposed within the housing and accessible through an opening, wherein the thermally conductive receptacle is sized to receive, completely contain and heat a container containing a condom, a personal lubricant, a liquid used in sexual activities or combination thereof;

a cover attached to the housing and disposed over the opening to provide access to the thermally conductive receptacle and enclose the container containing the condom, the personal lubricant, the liquid used in sexual activities or combination thereof;

a heating element disposed within the housing, and connected to the thermally conductive receptacle;

a temperature sensor disposed within the housing and connected to the heating element or the thermally conductive receptacle;

a user interface disposed on the housing;

a controller disposed within the housing and electrically connected to the heating element, the temperature sensor, and the user interface, wherein the controller (a) activates the heating element in response to a signal from the user interface, and (b) deactivates the heating element and provides a status indicator via the user interface whenever the temperature sensor indicates a desired temperature of between 80 and 135 degrees Fahrenheit; and a power source disposed within the housing and connected to the first heating element and the controller.

2. The device as recited in claim 1, wherein:

the cover comprises an insulated cover that reduces heat loss from the thermally conductive receptacle; and the cover is lockable such that the cover cannot be opened whenever the heating element is activated.

3. The device as recited in claim 1, further comprising:

a receptacle opening disposed in a side or bottom of the thermally conductive receptacle;

a hollow piercing element disposed within the housing proximate to the receptacle opening such that the piercing element penetrates the container of the personal lubricant, the liquid used in sexual activities or combination thereof held within the thermally conductive receptacle;

a valve removably secured to the housing and connected to the hollow piercing element by a passageway;

a valve regulator connected to the valve that controls a flow of the personal lubricant, the liquid used in sexual activities or combination thereof out of the container, and through the hollow piercing element, the passageway and the valve.

4. The device as recited in claim 3, wherein the valve comprises a pump mechanically driven by movement of the valve regulator or electrically driven by the power source.

5. The device as recited in claim 3, wherein the temperature sensor comprises a temperature probe disposed within the hollow piercing element, the passageway or the valve to determine the actual temperature of the personal lubricant, the liquid used in sexual activities or combination thereof.

6. The device as recited in claim 3, wherein the valve pivots with respect to the housing.

7. The device as recited in claim 1, wherein:

user interface comprises a control switch and a visual display;

the status indicator comprises a visual indicator, an audible indicator or a combination of the visual indicator and the audible indicator; and the controller is programmable via the user interface.

8. The device as recited in claim 1, wherein:

the power source comprises a battery, a rechargeable battery, a solar panel, an AC/DC power source or a combination thereof;

the user interface comprises a button, a slide switch, a toggle switch, a dial, a touch screen or a combination thereof; and the desired temperature is adjustable via the user interface.

9. The device as recited in claim 1, wherein the controller further (c) deactivates the heating element after a time period regardless of the temperature indicated by the temperature sensor.

10. A heating device comprising:

a housing;

a first thermally conductive receptacle disposed within the housing and accessible through a first opening, wherein the first thermally conductive receptacle is sized to receive, completely contain and heat a first container containing a first personal lubricant or a first liquid used in sexual activities;

a second thermally conductive receptacle disposed within the housing and accessible through a second opening, wherein the second thermally conductive receptacle is sized to receive, completely contain and heat a second container containing a condom immersed in a second personal lubricant or a second liquid used in sexual activities;

a first cover attached to the housing and disposed over the first opening and partially over the second opening to provide access to the first thermally conductive receptacle and the second thermally conductive receptacle, enclose the first container within the first thermally conductive receptacle and enclose the second container within the second thermally conductive receptacle;

a second cover attached to the housing and disposed over the second opening to provide access to the second thermally conductive receptacle and enclose the second container within the second thermally conductive receptacle;

a first heating element disposed within the housing and connected to the first thermally conductive receptacle or the second thermally conductive receptacle;

a first temperature sensor disposed within the housing and connected to the first heating element or the first thermally conductive receptacle or the second thermally conductive receptacle;

a user interface disposed on the housing;

a controller disposed within the housing and electrically connected to the heating element, the temperature sensor, and the user interface, wherein the controller (a) activates the heating element in response to a first signal from the user interface, and (b) deactivates the heating element and provides a first status indicator via the user interface whenever the temperature sensor indicates a desired temperature of between 80 and 135 degrees Fahrenheit; and a power source disposed within the housing and connected to the first heating element and the controller.

11. The device as recited in claim 10, further comprising:

a second heating element disposed within the housing and connected to the second thermally conductive receptacle;

wherein the first beating element is not connected to the second thermally conductive receptacle;

a second temperature sensor disposed within the housing and connected to the second heating element or the second thermally conductive receptacle;

wherein the first temperature sensor is not connected to the second thermally conductive receptacle; and wherein the controller further (c) activates the second heating element in response first signal from the user interface, and (d) deactivates the second heating element and provides a second status indicator via the user interface whenever the second temperature sensor indicates a desired temperature of between 80 and 135 degrees Fahrenheit.

12. The device as recited in claim 10, wherein:

the cover comprises an insulated cover that reduces heat loss from the thermally conductive receptacle; and the cover is lockable such that the cover cannot be opened whenever the heating element is activated.

13. The device as recited in claim 10, further comprising:

a receptacle opening disposed in a side or bottom of the thermally conductive receptacle;

a hollow piercing element disposed within the housing proximate to the receptacle opening such that the piercing element penetrates the first container held within the thermally conductive receptacle;

a valve removably secured to the housing and connected to the hollow piercing element by a passageway;

a valve regulator connected to the valve that controls a flow of the first personal lubricant or the first liquid used in sexual activities out of the first container, and through the hollow piercing element, the passageway and the valve.

14. The device as recited in claim 13, wherein the valve comprises a pump mechanically driven by movement of the valve regulator or electrically driven by the power source.

15. The device as recited in claim 13, wherein the temperature sensor comprises a temperature probe disposed within the hollow piercing element, the passageway or the valve to determine the actual temperature of the first personal lubricant or the first liquid used in sexual activities.

16. The device as recited in claim 13, wherein the valve pivots with respect to the housing.

17. The device as recited in claim 10, wherein:

user interface comprises a control switch and a visual display;

the status indicator comprises a visual indicator, an audible indicator or a combination of the visual indicator and the audible indicator; and the controller is programmable via the user interface.

18. The device as recited in claim 10, wherein:

the power source comprises a battery, a rechargeable battery, a solar panel, an AC/DC power source or a combination thereof;

the user interface comprises a button, a slide switch, a toggle switch, a dial, a touch screen or a combination thereof; and the desired temperature is adjustable via the user interface.

19. The device as recited in claim 10, wherein the controller further (c) deactivates the first heating element after a time period regardless of the temperature indicated by the first temperature sensor.

20. The device as recited in claim 10, wherein the second cover attached to the housing and disposed over the second opening further comprises an opening in the top of the cover that allows pressure to be manually applied to an exothermic heat generating element enclosed within the second container containing the condom immersed in the second personal lubricant or the second liquid used in sexual activities thereby activating said element.

21. The device as recited in claim 10, wherein the second cover attached to the housing and disposed over the second opening further comprises a spring-loaded plunger positioned within the second cover, wherein the spring-loaded plunger is used to activate an exothermic heat generating element enclosed within the second container containing the condom immersed in the second personal lubricant or the second liquid used in sexual activities.

22. A heating device comprising:

a housing;

a first thermally conductive receptacle disposed within the housing and accessible through a first opening, wherein the thermally conductive receptacle is sized to receive, completely contain and heat a first container containing a first personal lubricant or a first liquid used in sexual activities;

a second thermally conductive receptacle disposed within the housing and accessible through a second opening, wherein the second thermally conductive receptacle is sized to receive, completely contain and heat a second container containing a condom immersed in a second personal lubricant or a second liquid used in sexual activities;

a first cover attached to the housing and disposed over the first opening and partially over the second opening to provide access to the first thermally conductive receptacle and the second thermally conductive receptacle, enclose the first container within the first thermally conductive receptacle and enclose the second container within the second thermally conductive receptacle;

a second cover attached to the housing and disposed over the second opening to provide access to the second thermally conductive receptacle and enclose the second container within said receptacle;

a first heating element disposed within the housing and connected to the first thermally conductive receptacle;

a first temperature sensor disposed within the housing and connected to the first heating element or the first thermally conductive receptacle;

a second heating element disposed within the housing and connected to the second thermally conductive receptacle;

a second temperature sensor disposed within the housing and connected to the second heating element or the second thermally conductive receptacle;

a user interface disposed on the housing;

a controller disposed within the housing and electrically connected to the first heating element and the second heating element, the first temperature sensor and the second temperature sensor and the user interface, wherein the controller (a) activates the first heating element in response a first signal from the user interface, and (b) deactivates the first heating element and provides a first status indicator via the user interface whenever the temperature sensor indicates a desired temperature of between 90 and 135 degrees Fahrenheit; (c) activates the second heating element in response to a second signal from the user interface, and (d) deactivates the second heating element and provides a second status indicator via the user interface whenever the second temperature sensor indicates a desired temperature of between 80 and 135 degrees Fahrenheit;

a power source disposed within the housing and connected to the first heating element, the status indicator, the control switch and the controller; and a valve assembly removably secured to the housing, the valve assembly used to mechanically discharge the first personal lubricant or the first liquid used in sexual activities for use, and comprised of a piercing element used to penetrate the first container held within the first thermally conductive receptacle, a passageway connecting a valve to the piercing element, a valve regulator controlling the flow of the first personal lubricant or the first liquid used in sexual activities out of the first container.

23. The device as recited in claim 22, wherein:

the first cover and the second cover each comprise an insulated cover that reduces heat loss from the corresponding thermally conductive receptacle; and the first cover and second cover are lockable such that the first and second covers cannot be opened whenever the corresponding heating element is activated.

24. The device as recited in claim 22, wherein the valve comprises a pump mechanically driven by movement of the valve regulator or electrically driven by the power source.

25. The device as recited in claim 22, wherein the first temperature sensor comprises a temperature probe disposed within the hollow piercing element, the passageway or the valve to determine the actual temperature of the first personal lubricant or the first liquid used in sexual activities.

26. The device as recited in claim 22, wherein the valve pivots with respect to the housing.

27. The device as recited in claim 22, wherein:

user interface comprises a control switch and a visual display;

the status indicator comprises a visual indicator, an audible indicator or a combination of the visual indicator and the audible indicator; and the controller is programmable via the user interface.

28. The device as recited in claim 22, wherein:

the power source comprises a battery, a rechargeable battery, a solar panel, an AC/DC power source or a combination thereof;

the user interface comprises a button, a slide switch, a toggle switch, a dial, a touch screen or a combination thereof; and the desired temperature is adjustable via the user interface.

29. The device as recited in claim 22, wherein the controller further (e) deactivates the first heating element or the second heating element after a time period regardless of the temperature indicated by the corresponding temperature sensor.

30. The device as recited in claim 22, wherein the second cover attached to the housing and disposed over the second opening further comprises an opening in the top of the cover that allows pressure to be manually applied to an exothermic heat generating elements enclosed within the second container containing the condom immersed in the second personal lubricant or the second liquid used in sexual activities thereby activating said element.

31. The device as recited in claim 22, wherein the second cover attached to the housing and disposed over the second opening further comprises a spring-loaded plunger positioned within the second cover, wherein the spring-loaded plunger is used to activate an exothermic heat generating element enclosed within the second container containing the condom immersed in the second personal lubricant or the second liquid used in sexual activities.

* * * * *